US010656669B2

(12) United States Patent
Dawson et al.

(10) Patent No.: US 10,656,669 B2
(45) Date of Patent: May 19, 2020

(54) TRIGGER GUARD AND PENDANT FOR A PORTABLE HYDRAULIC POWER UNIT

(71) Applicant: Graco Minnesota Inc., Minneapolis, MN (US)

(72) Inventors: Charles W. Dawson, Otsego, MN (US); Douglas S. Ryder, Buffalo, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 59 days.

(21) Appl. No.: 15/965,036

(22) Filed: Apr. 27, 2018

(65) Prior Publication Data

US 2018/0314288 A1 Nov. 1, 2018

Related U.S. Application Data

(60) Provisional application No. 62/491,539, filed on Apr. 28, 2017.

(51) Int. Cl.

| | |
|---|---|
| ***G05G 5/00*** | (2006.01) |
| ***G05G 1/04*** | (2006.01) |
| ***F15B 21/08*** | (2006.01) |
| ***F04B 35/06*** | (2006.01) |
| ***F04B 41/02*** | (2006.01) |
| ***F04B 9/02*** | (2006.01) |
| ***F04B 17/03*** | (2006.01) |
| ***F04B 23/02*** | (2006.01) |
| ***F04B 23/06*** | (2006.01) |
| ***F04B 11/00*** | (2006.01) |

(Continued)

(52) U.S. Cl.

CPC ..... *G05G 5/005* (2013.01); *F04B 9/02* (2013.01); *F04B 11/005* (2013.01); *F04B 17/03* (2013.01); *F04B 17/06* (2013.01); *F04B 23/02* (2013.01); *F04B 23/025* (2013.01); *F04B 23/06* (2013.01); *F04B 35/06* (2013.01); *F04B 41/02* (2013.01); *F04B 49/225* (2013.01); *F04B 53/10* (2013.01); *F15B 21/08* (2013.01); *G05G 1/04* (2013.01); *G05G 2505/00* (2013.01)

(58) Field of Classification Search

CPC ..... H01H 3/20; H01H 2009/066; H01H 2009/068; H01H 9/0214; H01H 21/00; H01H 2009/065; H01H 2223/04; H01H 9/06; H01H 13/08; H01H 21/10

USPC ..... 200/43.17, 505, 522, 332.2, 43.16, 334, 200/293.1

See application file for complete search history.

(56) References Cited

U.S. PATENT DOCUMENTS 3,379,852 A 4/1968 Korshak
3,654,415 A 4/1972 Hawkins et al.
(Continued)

*Primary Examiner* — Edwin A. Leon
*Assistant Examiner* — Lheiren Mae A Caroc
(74) *Attorney, Agent, or Firm* — Kinney & Lange, P.A.

(57) ABSTRACT

A trigger guard for a pendant for controlling a hydraulic power unit includes a first prong extending from a front side of a handle of the pendant; a second prong extending from the front side of the handle; a groove disposed between the first prong and the second prong, the groove defined by the first prong, the second prong, and the handle; a first gap disposed between the first prong and a head of the pendant; and a second gap disposed between the second prong and the head. The trigger is disposed between the first prong and the second prong such that the trigger is accessible through the groove, the first gap, and the second gap.

23 Claims, 18 Drawing Sheets

(51) Int. Cl.

| | |
|---|---|
| ***F04B 17/06*** | (2006.01) |
| ***F04B 49/22*** | (2006.01) |
| ***F04B 53/10*** | (2006.01) |

(56) References Cited

U.S. PATENT DOCUMENTS

| | | | | |
|---|---|---|---|---|
| 3,715,544 | A | 2/1973 | Duve | |
| 3,931,486 | A | 1/1976 | Raetz | |
| 4,105,882 | A | 8/1978 | Ulbing et al. | |
| 4,152,563 | A | 5/1979 | Bongort | |
| 4,849,587 | A | 7/1989 | Bacon | |
| 5,239,143 | A * | 8/1993 | Valenzona | H01H 27/00 200/339 |
| 6,700,091 | B2 | 3/2004 | Jones et al. | |
| D527,966 | S | 9/2006 | Hayakawa et al. | |
| D552,562 | S | 10/2007 | Yamamoto et al. | |
| D662,477 | S | 6/2012 | Hagan et al. | |
| D685,241 | S | 7/2013 | Waldron | |
| D700,031 | S | 2/2014 | Aglassinger | |
| D714,739 | S | 10/2014 | Rantala | |
| D715,230 | S | 10/2014 | Rantala | |
| 2010/0258631 | A1 * | 10/2010 | Rueblinger | G06K 7/10881 235/462.48 |

* cited by examiner

TRIGGER GUARD AND PENDANT FOR A PORTABLE HYDRAULIC POWER UNIT

CROSS-REFERENCE TO RELATED APPLICATION(S)

This application claims priority to U.S. Provisional Application No. 62/491,539 filed Apr. 28, 2017, and entitled "PORTABLE HYDRAULIC POWER UNIT," the disclosure of which is hereby incorporated in its entirety. This application is being filed with related U.S. patent application Ser. No. 15/965,005, entitled "PORTABLE HYDRAULIC POWER UNIT," filed Apr. 27, 2018; U.S. patent application Ser. No. 15/965,027, entitled "PORTABLE HYDRAULIC POWER UNIT," filed Apr. 27, 2018; and U.S. patent application Ser. No. 15/965,028, entitled "SOLENOID VALVE FOR A PORTABLE HYDRAULIC POWER UNIT," filed Apr. 27, 2018, the disclosures of which are related.

BACKGROUND

This disclosure relates generally to hydraulic power units. More particularly, this disclosure relates to portable hydraulic power units.

Hydraulic power units drive hydraulic fluid to a hydraulically-driven tool under pressure to cause the hydraulically-driven tool to perform work. Hydraulic power units include multiple pumps that pump the hydraulic fluid through a hydraulic circuit to the hydraulically-driven tool. The pumps are typically plunger pumps that are submerged in the hydraulic fluid in a fluid tank of the hydraulic power unit. The pumps also include georotor pumps submerged in the hydraulic fluid for high-flow applications. The in-tank pumps are exposed to hydraulic fluid on both an interior and an exterior of the pumps. To build sufficiently high pressure to drive the hydraulically-driven tool, the hydraulic power unit utilizes staged approach. Each stage is relieved by a spring-loaded relief valve when that stages maximum pressure is achieved.

A lid enclosed the fluid tank, and a long gasket with a geometry matching the geometry of the top of the fluid tank is disposed between the lid and the fluid tank to prevent contaminants from entering the fluid tank. To service an in-tank pump, the user removes the lid, which can expose the hydraulic fluid to contamination, and retrieves the in-tank pump from the hydraulic fluid. In addition, the fluid tank can be mounted below the other systems on the hydraulic power unit, such that the user is required to remove the other systems prior to accessing the tank. When returning the hydraulic power unit to service, the user is required to properly seat the long gasket between the fluid tank and the lid to prevent leakage.

SUMMARY

According to one aspect of the disclosure, a trigger guard for a pendant for controlling a hydraulic power unit includes a first prong extending from a first end of a cross-piece; a second prong extending from a second end of the cross-piece; a groove disposed between the first prong and the second prong, the groove defined by the first prong, the second prong, and the cross-piece; a first side guard extending vertically from the cross-piece and the first prong; a second side guard extending vertically from the cross-piece and the second prong; a first gap disposed between the first prong and the first side guard; and a second gap disposed between the second prong and the second side guard. The first side guard and the second side guard are spaced to receive a trigger extending from between the first side guard and the second side guard such that the trigger is accessible through the groove, the first gap, and the second gap.

According to another aspect of the disclosure, a method of controlling a hydraulic power unit with a pendant having a head, a handle extending from the head, and a trigger extending from a front side of the handle proximate the head and disposed within a trigger guard extending from the front side, the trigger guard having a first prong, a second prong spaced laterally from the first prong, a groove disposed between the first prong and the second prong, a first gap disposed between the first prong and the head, and a second gap disposed between the second prong and the head includes grasping the handle of the pendant in one of a left-hand orientation and a right-hand orientation; and accessing the trigger via one of the first gap, the second gap, and the groove.

According to yet another aspect of the disclosure, a pendant having a trigger for controlling a hydraulic power unit, the trigger actuatable by either a finger or a thumb of a user's hand gripping the pendant includes a body having a first side and a second side opposite the first side and a trigger located on the first side of the body. The body includes a grip configured to be held by a user's hand, the grip extending between the first side and the second side of the body; a pair of prongs located on the first side of the body; and a groove located on the first side of the body and defined by and between the pair of prongs, each of the prongs having a free end that is not bridged to the free end of the other prong such that the groove is open. The trigger is aligned with the groove, and the pair of prongs are located between the trigger and the grip along the body. The body is configured to be held in first and second orientations. In the first orientation the user's hand grips the grip and the user's thumb moves in the groove between the pair of prongs to actuate the trigger. In the second orientation the user's hand grips the grip and the user's finger actuates the trigger without moving within the groove between the pair of prongs.

According to yet another aspect of the disclosure, a method of actuating a pendant having a trigger for controlling a hydraulic power unit, the pendant comprising a trigger and a body having a first side and a second side opposite the first side, the body comprising a grip extending between the first side and the second side of the body, a pair of prongs located on the first side of the body, and a groove located on the first side of the body and defined by and between the pair of prongs, each of the prongs having a free end that is not bridged to the free end of the other prong such that the groove is open, the trigger located on the first side of the body and aligned with the groove, the pair of prongs located between the trigger and the grip along the body, includes actuating the trigger in a first orientation in which the user's hand grips the grip while the user's thumb of the hand moves in the groove between the pair of prongs to access the trigger; and actuating the trigger in a second orientation in which the user's hand grips the grip while the user's finger of the hand accesses the trigger without moving between the pair of prongs.

DETAILED DESCRIPTION

Figure 1:
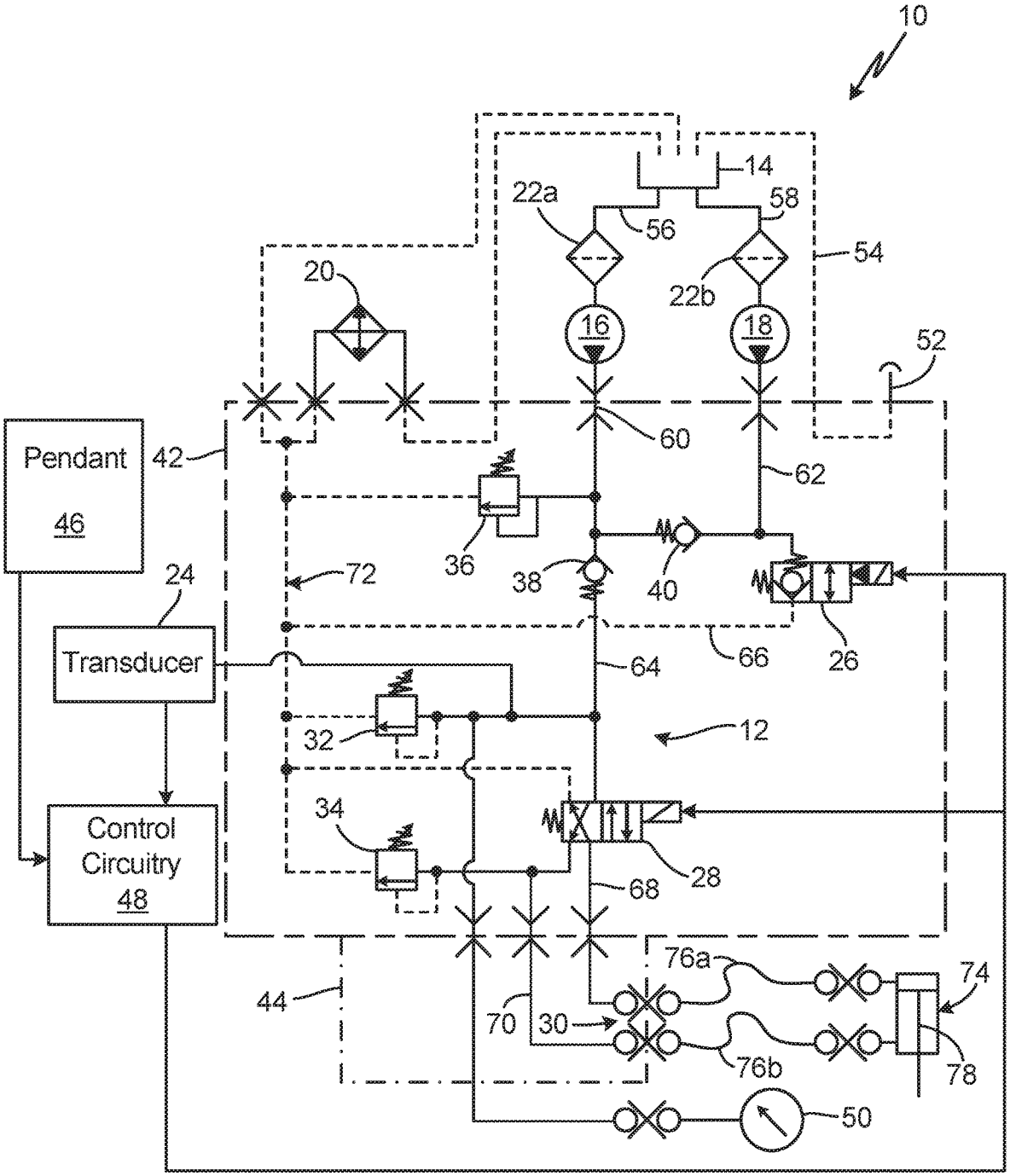
FIG. 1 is a schematic diagram of a hydraulic power unit.

FIG. 1 is a schematic diagram of hydraulic power unit ("HPU") 10, which includes hydraulic circuit 12, fluid reservoir 14, pump 16, pump 18, oil cooler 20, strainer 22*a*, strainer 22*b*, transducer 24, two-way valve 26, four-way valve 28, fluid ports 30, high-pressure relief valve 32, low-pressure relief valve 34, variable pressure relief valve 36, first check valve 38, second check valve 40, valve manifold 42, distribution manifold 44, pendant 46, control circuitry 48, gauge 50, vent 52, and vent line 54. Hydraulic circuit 12 includes first pump supply line 56, second pump supply line 58, high-pressure line 60, high-flow line 62, combined flow line 64, high-flow return line 66, tool extension line 68, tool retraction line 70, and system return line 72. Tool 74 is driven by hydraulic fluid provided by HPU 10 through external hydraulic hose 76*a* and external hydraulic hose 76*b*, and tool 74 includes tool piston 78.

Fluid reservoir 14 is configured to store a supply of hydraulic fluid for powering tool 74. Vent line 54 extends from fluid reservoir 14 to vent 52. Vent 52 maintains fluid reservoir 14 at relatively low or atmospheric pressure. First pump supply line 56 extends from fluid reservoir 14 to pump 16. Strainer 22*a* is disposed on first pump supply line 56 and is configured to remove contaminants from the hydraulic fluid prior to the hydraulic fluid entering pump 16. Second pump supply line 58 extends from fluid reservoir 14 to pump 18. Strainer 22*b* is disposed on second pump supply line 58 and is configured to remove contaminants from the hydraulic fluid prior to the hydraulic fluid entering pump 18. First pump supply line 56 and second pump supply line 58 can be integrally formed with fluid reservoir 14, such that pump 16 and pump 18 are mounted directly to fluid reservoir 14.

Control circuitry 48 communicates with transducer 24, two-way valve 26, four-way valve 28, and pendant 46. Control circuitry 48 is electrically connected to transducer 24, two-way valve 26, and four-way valve 28, and control circuitry 48 can be of any suitable configuration for controlling the operation of two-way valve 26 and four-way valve 28, for gathering data, for processing data, etc. In some examples, control circuitry 48 includes a memory configured to store software, that when executed by control circuitry, causes control circuitry 48 to control the position of two-way valve 26 and four-way valve 28. The memory can also store information during operation, such as a threshold pressure level. The memory can include any suitable storage medium, such as volatile and/or non-volatile memory, among any other desired option. Control circuitry 48 can further include a processor such as a microprocessor, controller, digital signal processor (DSP), application specific integrated circuit (ASIC), field-programmable gate array (FPGA), or other equivalent discrete or integrated circuitry. The processor can execute the software stored on memory.

Control circuitry 48 can be implemented as a plurality of discrete circuitry subassemblies. For example, a discrete control circuitry subassembly can receive hydraulic pressure data from transducer 24 and control the position of two-way valve 26 based on the hydraulic pressure data. Transducer 24 can be of any suitable configuration for sensing the hydraulic pressure in combined flow line 64, including an analog switch or electronic sensor. One or more other discrete control circuitry subassemblies can receive commands from pendant 46 to control the position of four-way valve 28 independent of control circuitry 48 controlling the position of two-way valve 26. Pendant 46 is configured to provide commands to control circuitry 48 via wired or wireless communications.

Pump 16 is a high-pressure pump configured to pump at a relatively high pressure and relatively low fluid volume with regard to pump 18. To contrast, pump 18 is a high-flow pump configured to pump at a relatively low pressure and relatively high fluid volume with regard to pump 16. For example, pump 16 can be configured to pump fluid at about 70 MPa (about 10,000 psi), while pump 18 can be configured to pump fluid at about 25 MPa (about 3,500 psi). Pump 16 and pump 18 are mechanically connected to a drive mechanism, such as drive mechanism 86 (best seen in FIG. 4B), such that pump 16 and pump 18 are simultaneously driven. As such, HPU 10 is configured such that both pump 16 and pump 18 continuously drive hydraulic fluid through hydraulic circuit 12 when HPU 10 is operating.

High-pressure line 60 extends downstream from pump 16 to an upstream side of first check valve 38 and a downstream side of second check valve 40. High-flow line 62 extends downstream from pump 18 to two-way valve 26 and to an upstream side of second check valve 40. High-flow line 62 extends into high-pressure line 60 upstream of first check valve 38, and the combined high-flow line 62 and high-pressure line 60 form combined flow line 64. It is understood, that high-pressure line 60 and combined flow line 64 form a part of a single flow line between pump 16 and four-way valve 28. As such, pump 16 provides a first flow of hydraulic fluid to combined flow line 64. First check valve 38 and second check valve 40 can be of any suitable configuration for preventing retrograde flow to pump 16 and pump 18.

Variable pressure relief valve 36 is configured to control the maximum hydraulic fluid pressure within hydraulic circuit 12. Variable pressure relief valve 36 releases the hydraulic fluid output from one or both of pump 16 and pump 18 to system return line 72 when the hydraulic fluid pressure is above a set maximum pressure level for variable pressure relief valve 36. The set maximum pressure level for variable pressure relief valve 36 can be mechanically adjustable. For example, to adjust the set maximum pressure level a user can adjust the nominal tension on a spring that presses a ball against a seat of variable pressure relief valve 36.

Two-way valve 26 is controlled between an open state and a closed state by control circuitry 48 based on the hydraulic pressure level within combined flow line 64. Two-way valve 26 is an electrically actuated valve. It is understood that two-way valve 26 can be any suitable valve for directing the output of pump 18 to discrete outlets associated with either combined flow line 64 or system return line 72. In some examples, two-way valve 26 is a solenoid operated valve. For example, control circuitry 48 can activate and deactivate a solenoid to cause an internal component, such as a flap or spool, configured to route the hydraulic fluid through a valve body of two-way valve 26 to shift between an open position and a closed position. High-flow return line 66 extends from two-way valve 26 to system return line 72. System return line 72 is also disposed downstream of variable pressure relief valve 36, high-pressure relief valve 32, low-pressure relief valve 34, and four-way valve 28. System return line 72 is configured to return hydraulic fluid to fluid reservoir 14 and/or to oil cooler 20 and then to fluid reservoir 14. Oil cooler 20 is configured to remove excess heat from the hydraulic fluid.

Combined flow line 64 extends downstream from first check valve 38 to four-way valve 28, high-pressure relief valve 32, and pressure gauge 50. Transducer 24 is connected to combined flow line 64 and is configured to sense the hydraulic pressure within combined flow line. Transducer 24 provides hydraulic pressure data to control circuitry 48. High-pressure relief valve 32 is connected to combined flow line 64 upstream of four-way valve 28. High-pressure relief valve 32 is a safety valve configured to release hydraulic fluid to system return line 72 when the hydraulic fluid pressure in combined flow line 64 exceeds a maximum system operating pressure. In some examples, high-pressure relief valve 32 is configured to release the flow of hydraulic fluid to system return line 72 when the hydraulic fluid pressure exceeds about 75 MPa (about 10,850 psi). Pressure gauge 50 is connected to combined flow line 64 and is configured to provide a visual indication of the hydraulic fluid pressure to the user. Pressure gauge 50 can be of any suitable configuration for providing the visual indication, such as by an analog or digital readout.

Four-way valve 28 is connected to combined flow line 64 and receives the hydraulic fluid from combined flow line 64. Four-way valve 28 can be an electrically actuated valve. For example, four-way valve 28 can be a solenoid operated valve. Tool extension line 68 extends from four-way valve 28 to fluid ports 30. External hydraulic hose 76*a* extends from fluid ports 30 to tool 74. Tool retraction line 70 extends from four-way valve 28 to low-pressure relief valve 34 and fluid ports 30. External hydraulic hose 76*b* extends from fluid ports 30 to tool 74. In the extension state, four-way valve 28 routes hydraulic fluid both to tool extension line 68 from combined flow line 64 and to system return line 72 from tool retraction line 70. In the retraction state, four-way valve 28 routes hydraulic fluid both to tool retraction line 70 from combined flow line 64 and to system return line 72 from tool extension line 68. Tool piston 78 is disposed in tool 74 and is alternatingly driven through an extension stroke and a retraction stroke depending on the position of four-way valve 28.

Low-pressure relief valve 34 is mounted on tool retraction line 70 downstream of four-way valve 28. Low-pressure relief valve 34 is configured to limit the hydraulic fluid pressure provided to tool 74 during the retraction stroke of tool piston 78. Low-pressure relief valve 34 releases hydraulic fluid to system return line 72 when the hydraulic fluid pressure exceeds the preset limit of low-pressure relief valve 34. For example, desired for retraction of tool piston 78, such as about 10 MPa (about 1,500 psi).

During operation, pump 16 and pump 18 continuously draw hydraulic fluid from fluid reservoir 14 and drive the hydraulic fluid through hydraulic circuit 12. Control circuitry 48 positions four-way valve 28 based on commands received from pendant 46, and four-way valve 28 directs the hydraulic fluid to tool 74. Tool piston 78 proceeds through an extension stroke and a retraction stroke to perform work. The speed of tool 74 is proportional to the flow rate of the hydraulic fluid flowing to tool 74, and the torque of tool 74 is proportional to the hydraulic fluid pressure provided to tool 74. During the extension stroke, low flow at relatively high pressures, about 70 MPa (about 10,000 psi) is desired to generate high torque tool 74 movement. During the retraction stroke, high flow at relatively low pressures, about 25 MPa (about 3,500 psi), is desired for fast tool 74 movement.

To cause tool piston 78 to enter the extension stroke, the user depresses a trigger of pendant 46, which causes pendant 46 to generate and provide an extension command to control circuitry 48. Based on the extension command, control circuitry 48 causes four-way valve 28 to shift to an extension state such that the hydraulic fluid from combined flow line 64 is provided to tool extension line 68. The hydraulic fluid flows through tool extension line 68, through fluid ports 30, and is provided to tool 74 through external hydraulic hose 76*a*. The hydraulic fluid drives tool piston 78 through the extension stroke.

A limited amount of electrical current (about twenty amperes) is typically available at a job site. A motor, such as motor 84 (best seen in FIGS. 2A-2B), of HPU 10, which drives pump 16 and pump 18, is configured to use only the limited electrical current. Due to the limited power resources, HPU 10 utilizes both pump 16 and pump 18 to balance high-flow and high-pressure demands without overwhelming the motor. During the extension stroke, the hydraulic fluid is provided to tool 74 at relatively high pressures about 70 MPa (about 10,000 psi) to generate high torque movement of tool 74. When the required hydraulic pressure is above a threshold pressure level, for example about 20 MPa-28 MPa (about 3,000-4,000 psi), then the motor can be overwhelmed by pump 18, which is a high-flow pump, pumping into the high-pressure hydraulic flow generated by pump 16. In one example, the threshold level is about 24 MPa (about 3,400 psi). As discussed above, pump 16 and pump 18 are mechanically-linked such that pump 16 and pump 18 simultaneously pump the hydraulic fluid. As such, pump 18 cannot be decoupled from pump 16 or otherwise deactivated during the extension stroke of tool piston 78.

The hydraulic fluid pressure in hydraulic circuit 12 continues to rise throughout the extension stroke as tool 74 encounters resistance. Initially, two-way valve 26 is in a closed state, such that hydraulic fluid from both pump 16 and pump 18 is provided to combined flow line 64. Transducer 24 senses the hydraulic fluid pressure within combined flow line 64 and provides the hydraulic pressure data to control circuitry 48. Control circuitry 48 is configured to control a position of two-way valve 26 based on a comparison of the hydraulic fluid data and the threshold pressure level. Control circuitry 48 causes two-way valve 26 to shift to and remain in an open state where the comparison of the hydraulic fluid data and the threshold pressure level indicates that the hydraulic fluid pressure is at or above the threshold level. As discussed above, two-way valve 26 can be a solenoid operated valve, such that control circuitry 48 causes actuation of two-way valve 26 by directing electrical power to two-way valve 26. It is understood that the threshold level can be set at any desired level up to and including the maximum hydraulic fluid pressure capacity of pump 18.

Control circuitry 48 compares the hydraulic fluid pressure data with the threshold level. Control circuitry 48 causes two-way valve 26 to shift to an open state based on the comparison indicating that the hydraulic fluid pressure in combined flow line 64 is at or above the threshold level. With two-way valve 26 in the open state, the hydraulic fluid from pump 18 flows directly to high-flow return line 66 and downstream to system return line 72. From system return line 72 the hydraulic fluid from pump 18 flows through oil cooler 20 and back to fluid reservoir 14. Pump 18 experiences relatively little resistance with two-way valve 26 in the open state as fluid reservoir 14 maintained at a relatively low or atmospheric pressure. Moreover, two-way valve 26 is maintained in the open state, such that pump 18 is not required to build the hydraulic fluid pressure in high-flow line to a sufficiently high level to cause two-way valve 26 to shift to an open state and relieve the hydraulic pressure. Pump 18 is prevented from driving fluid into combined flow line 64 because the hydraulic fluid pressure on the downstream side of second check valve 40, which is generated by pump 16, is higher than the hydraulic fluid pressure on the upstream side of second check valve 40. Opening two-way valve 26 reduces the load on pump 18 and reduces energy losses, such as losses due to heat generation, in hydraulic circuit 12. As such, less cooling of the hydraulic fluid is required, and oil cooler 20 can be less robust. Two-way valve 26 is maintained in the open state until control circuitry 48 causes two-way valve 26 to shift back to the closed state.

Pump 18 continues to drive the hydraulic fluid through the open two-way valve 26, while pump 16 drives the hydraulic fluid to combined flow line 64 and downstream to four-way valve 28. Four-way valve 28 directs the hydraulic fluid from combined flow line 64 to tool extension line 68, and the hydraulic fluid flows through tool extension line 68 and external hydraulic hose 76*a* to tool 74.

The user releases the trigger of pendant 46 to initiate a retraction stroke of tool piston 78. In one example, pendant 46 generates a retraction command based on the release of the trigger and provide the retraction command to control circuitry 48. In another example, releasing trigger causes pendant 46 to cease providing the extension command. Control circuitry 48 causes four-way valve 28 to shift to a retraction position based on the user releasing the trigger, such as in response to the retraction command. With four-way valve 28 in the retraction state, four-way valve directs the flow of hydraulic fluid to tool 74 to cause tool piston 78 to proceed through a retraction stroke.

The hydraulic fluid that drove tool piston 78 through the extension stroke flows upstream through external hydraulic hose 76*a* and tool extension line 68 to four-way valve 28. Four-way valve 28 directs the hydraulic fluid from tool extension line 68 to system return line 72, where the hydraulic fluid is returned to fluid tank 92. With four-way valve 28 in the retraction state, four-way valve 28 routes the flow of hydraulic fluid from combined flow line 64 to tool retraction line 70. The hydraulic fluid flows downstream through tool retraction line 70 to fluid ports 30 and downstream to tool 74 through external hydraulic hose 76*b*. Low-pressure relief valve 34 is disposed on tool retraction line 70 to maintain the hydraulic fluid pressure available for the retraction stroke below a desired level for tool piston 78 retraction, such as about 10 MPa (about 1,500 psi).

Control circuitry 48 causes two-way valve 26 to shift to the closed state based on a comparison of the hydraulic fluid data from transducer 24 and the threshold pressure level indicating that the hydraulic pressure in combined flow line 64 is below the threshold pressure level. With two-way valve 26 in the closed state, both pump 16 and pump 18 provide the hydraulic fluid to combined flow line 64 and thus downstream to tool retraction line 70 through four-way valve 28. The hydraulic fluid flows to tool 74 and drives tool piston 78 through the retraction stroke. Control circuitry 48 shifts four-way valve 28 back to the extension state based control circuitry 48 receiving another extension command, such as when the user again depresses the trigger of pendant 46.

HPU 10 provides significant advantages. Pump 16 and pump 18 balance high-flow and high-pressure demands without overwhelming the motor. Two-way valve 26 is an electrically-actuated valve that is maintained in the open state when the hydraulic fluid pressure is at or above the threshold level, directly connecting the output of pump 18 to reservoir and reducing the load on pump 18. Maintaining two-way valve 26 in the open state further reduces the load on pump 18 as compared to a mechanically-actuated valve because pump 18 is not required to build the pressure in high-flow line 62 to a level sufficient to open the mechanically-actuated valve. Maintaining two-way valve 26 in the open state further reduces energy losses in hydraulic circuit 12, such that less cooling of the hydraulic fluid is required, which allows HPU 10 to utilize a less robust oil cooler 20, thereby saving manufacturing and operating costs.

Figure 2A:
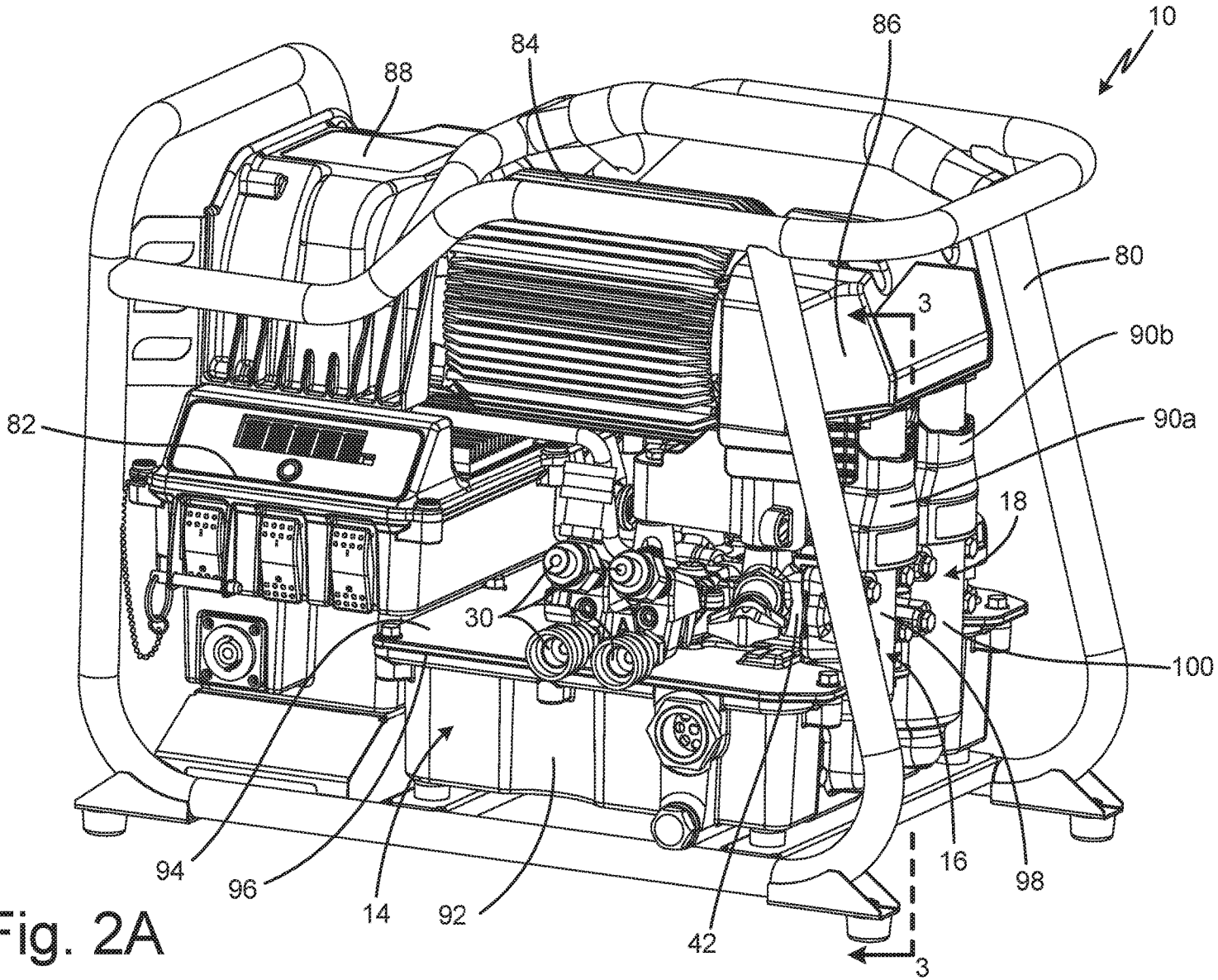
FIG. 2A is a first isometric view of a hydraulic power unit.
Figure 2B:
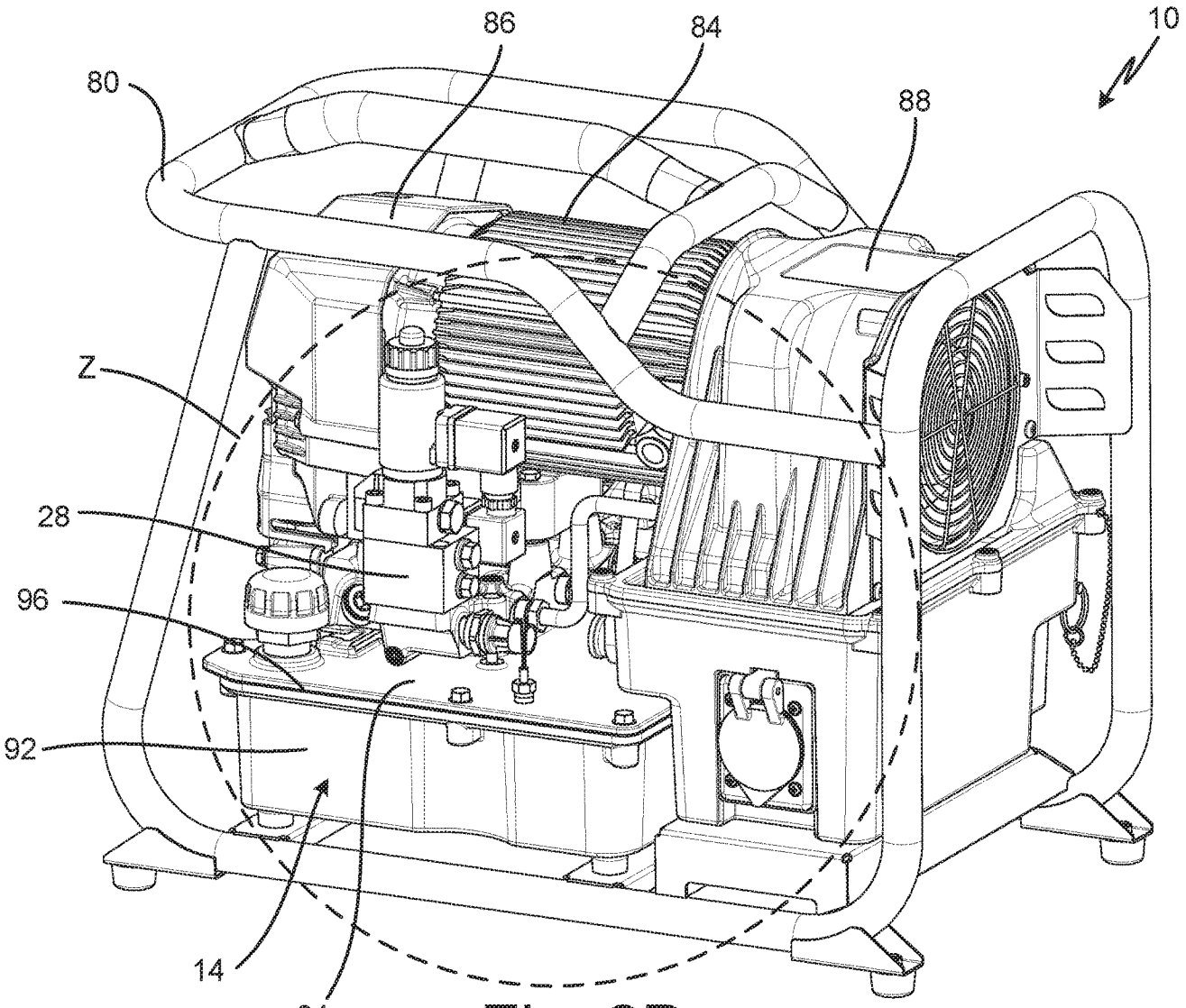
FIG. 2B is a second isometric view of a hydraulic power unit.
Figure 2C:
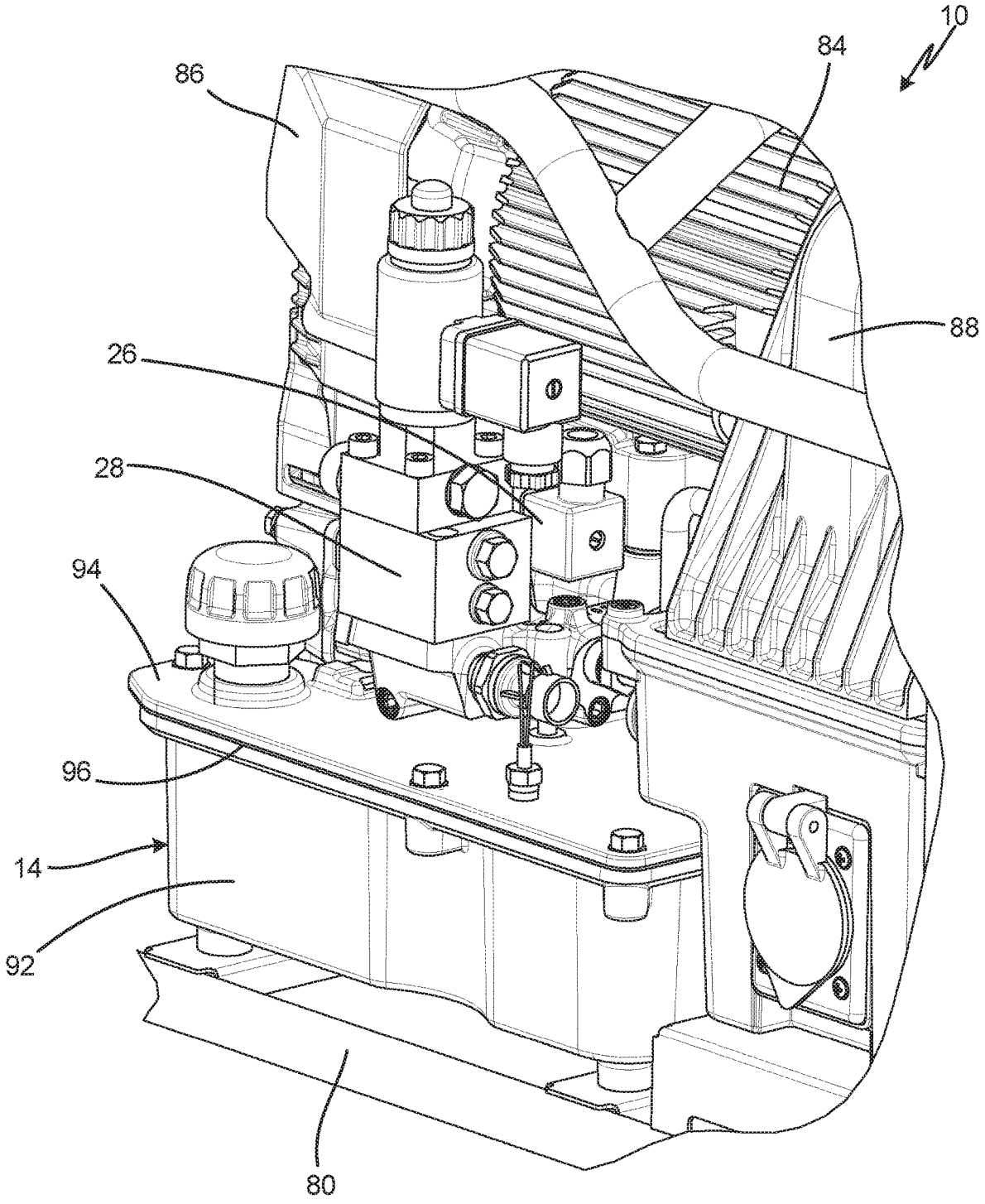
FIG. 2C is an enlarged isometric view detail Z in FIG. 2B.
Figure 2D:
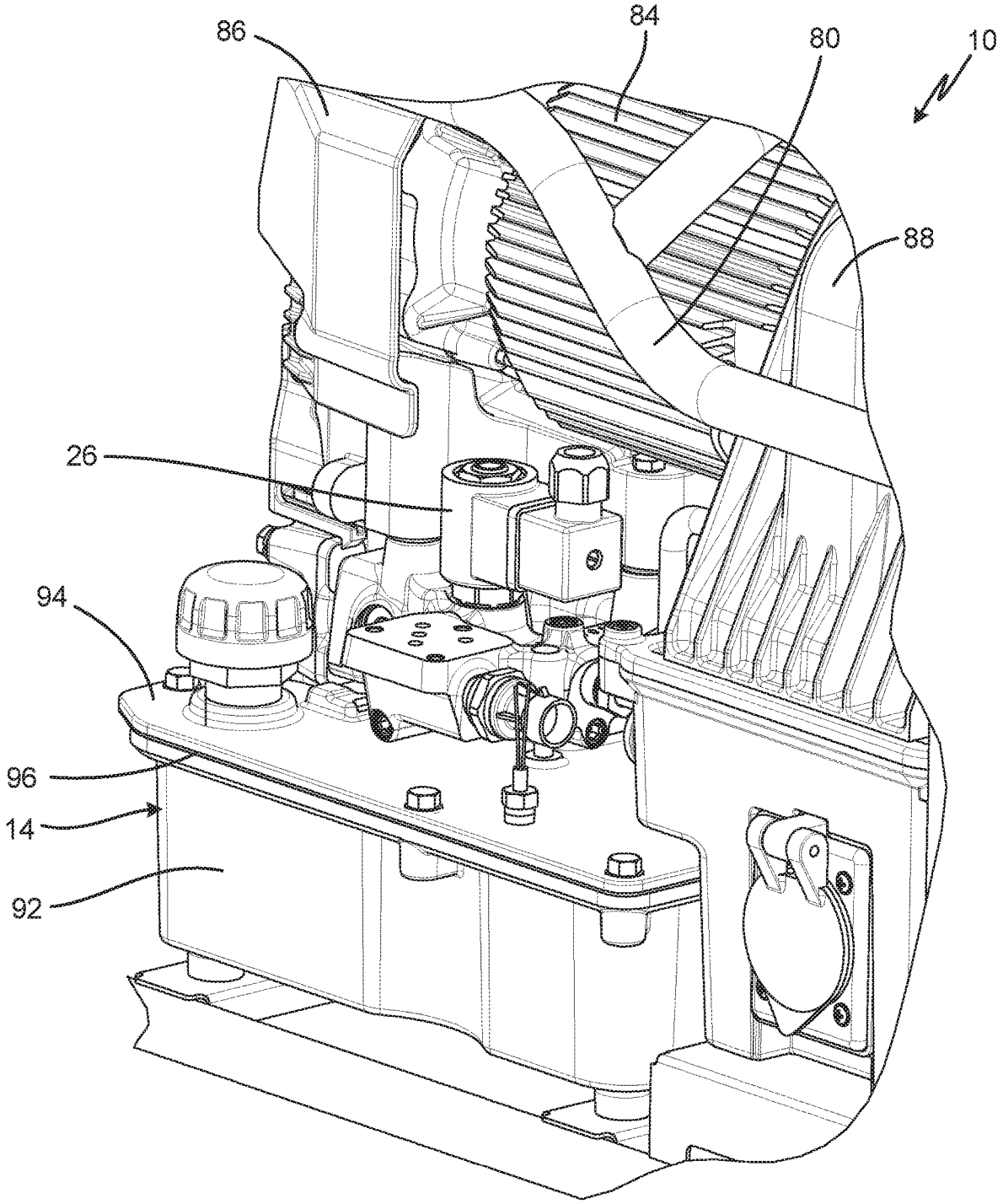
FIG. 2D is an enlarged isometric view of detail Z in FIG. 2B with a four-way valve removed.

FIG. 2A is a first isometric view of HPU 10. FIG. 2B is a second isometric view of HPU 10 from an opposite side of HPU 10. FIG. 2C is an enlarged view of detail Z in FIG. 2B. FIG. 2D is an enlarged view of detail Z in FIG. 2B with four-way valve 28 removed. FIGS. 2A-2D will be discussed together. HPU 10 includes fluid reservoir 14, pump 16 (FIG. 2A), pump 18 (FIG. 2A), two-way valve 26 (FIGS. 2C-2D), four-way valve 28 (FIGS. 2B-2C), fluid ports 30 (FIG. 2A), valve manifold 42 (FIG. 2A), frame 80, control unit 82 (FIG. 2A), motor 84, drive mechanism 86, fan shroud 88, first cover 90*a* (FIG. 2A), and second cover 90*b* (FIG. 2A). Fluid reservoir 14 includes fluid tank 92, lid 94, and gasket 96. Pump 16 includes cylinder body 98, and pump 18 includes cylinder body 100.

Frame 80 surrounds and supports the other components of HPU 10. Frame 80 is of any suitable material for providing structural integrity to HPU 10. For example, frame 80 can be formed from metallic tubing. Fluid reservoir 14 is disposed on frame 80. Fluid tank 92 is configured to store a supply of hydraulic fluid for powering a hydraulically-driven tool, such as tool 74 (FIG. 1). Lid 94 is disposed on fluid tank 92 and encloses the supply of hydraulic fluid within fluid tank 92. Gasket 96 is disposed between lid 94 and fluid tank 92 and is configured to form a seal between lid 94 and fluid tank 92. In some examples, gasket 96 is a long unitary seal that is shaped match an edge geometry of fluid tank 92.

Control unit 82 includes control circuitry 48 (shown in FIG. 1) and is mounted on frame 80. Fan shroud 88 is disposed above control unit 82 and encloses a cooler, such a oil cooler 20 (shown in FIG. 1), configured to remove excess heat from the hydraulic fluid. Motor 84 is mounted between fan shroud 88 and drive mechanism 86, and is configured to provide power to both the cooler and drive mechanism 86. Motor 84 can be of any suitable configuration for powering drive mechanism 86, such as, for example, an electromagnetic rotary motor or a gas powered motor. Drive mechanism 86 converts the rotational output of motor 84 into linear reciprocating movement to power both pump 16 and pump 18.

Pump 16 and pump 18 are mounted on a side of HPU 10 and are attached to both fluid tank 92 and valve manifold 42. Pump 16 and pump 18 are configured to drive hydraulic fluid under pressure. Pump 16 can be a high-pressure pump configured to pump at a relatively low fluid volume with regard to pump 18, while pump 18 can be a high-flow pump configured to pump at a relatively low pressure with regard to pump 16. Both pump 16 and pump 18 are configured to draw the hydraulic fluid from fluid tank 92 and drive the hydraulic fluid downstream to four-way valve 28 and out of fluid ports 30, where the hydraulic fluid is routed to the hydraulically-driven tool, such as tool 74 (FIG. 1). In some examples, both pump 16 and pump 18 are double-displacement pumps. Cylinder body 98 encloses the pumping elements of pump 16 and is directly mounted to fluid tank 92 and valve manifold 42. Similarly, cylinder body 100 encloses the pumping elements of pump 18 and is directly mounted to fluid tank 92 and valve manifold 42. It is understood that cylinder body 98 and cylinder body 100 do not necessarily have a cylindrical outer profile; instead, each of cylinder body 98 and cylinder body 100 include a cylindrical inner void within which a piston reciprocates to pump fluid. First cover 90 encloses the connection of pump 16 and drive mechanism 86. Second cover 90 encloses the connection of pump 18 and drive mechanism 86. In some examples, first cover 90 and second cover 90 can be integrally formed as a single part.

As discussed above with regard to FIG. 1, four-way valve 28 and two-way valve 26 are configured to route the hydraulic fluid through a hydraulic circuit, such as hydraulic circuit 12 (FIG. 1). Four-way valve 28 is mounted on valve manifold 42 of HPU 10, and four-way valve 28 is modular and accessible from an exterior or HPU 10. Four-way valve 28 is an electrically-actuated valve. In some examples, four-way valve 28 is a solenoid operated valve. Two-way valve 26 is mounted on valve manifold 42 of HPU 10, and two-way valve 26 is modular and accessible from an exterior of HPU 10. Two-way valve 26 is an electrically-actuated valve. In some examples, two-way valve 26 is solenoid operated valve. Valve manifold 42 routes the hydraulic fluid from pump 16 and pump 18 to four-way valve 28, and further routes the hydraulic fluid from pump 18 to two-way valve 26. Valve manifold 42 also routes the hydraulic fluid from four-way valve 28 to fluid ports 30.

During operation, motor 84 powers drive mechanism 86, and drive mechanism 86 drives pump 16 and pump 18 simultaneously. Pump 16 and pump 18 draw hydraulic fluid from fluid tank 92 and drive the hydraulic fluid downstream through the hydraulic circuit to four-way valve 28. Four-way valve 28 routes the hydraulic fluid downstream to the hydraulically-driven tool through fluid ports 30. As discussed above, two-way valve 26 is controlled between an open state and a closed state based on the hydraulic fluid pressure within the hydraulic circuit. Control circuitry, such as control circuitry 48 (FIG. 1), of HPU 10 is configured to shift two-way valve 26 to an open state such that two-way valve 26 routes the output of pump 18 back to fluid tank 92 when the hydraulic fluid pressure reaches and/or exceeds a threshold level. Shifting two-way valve to the open state reduces the work of pump 18, which reduces the load on motor 84.

Figure 3:
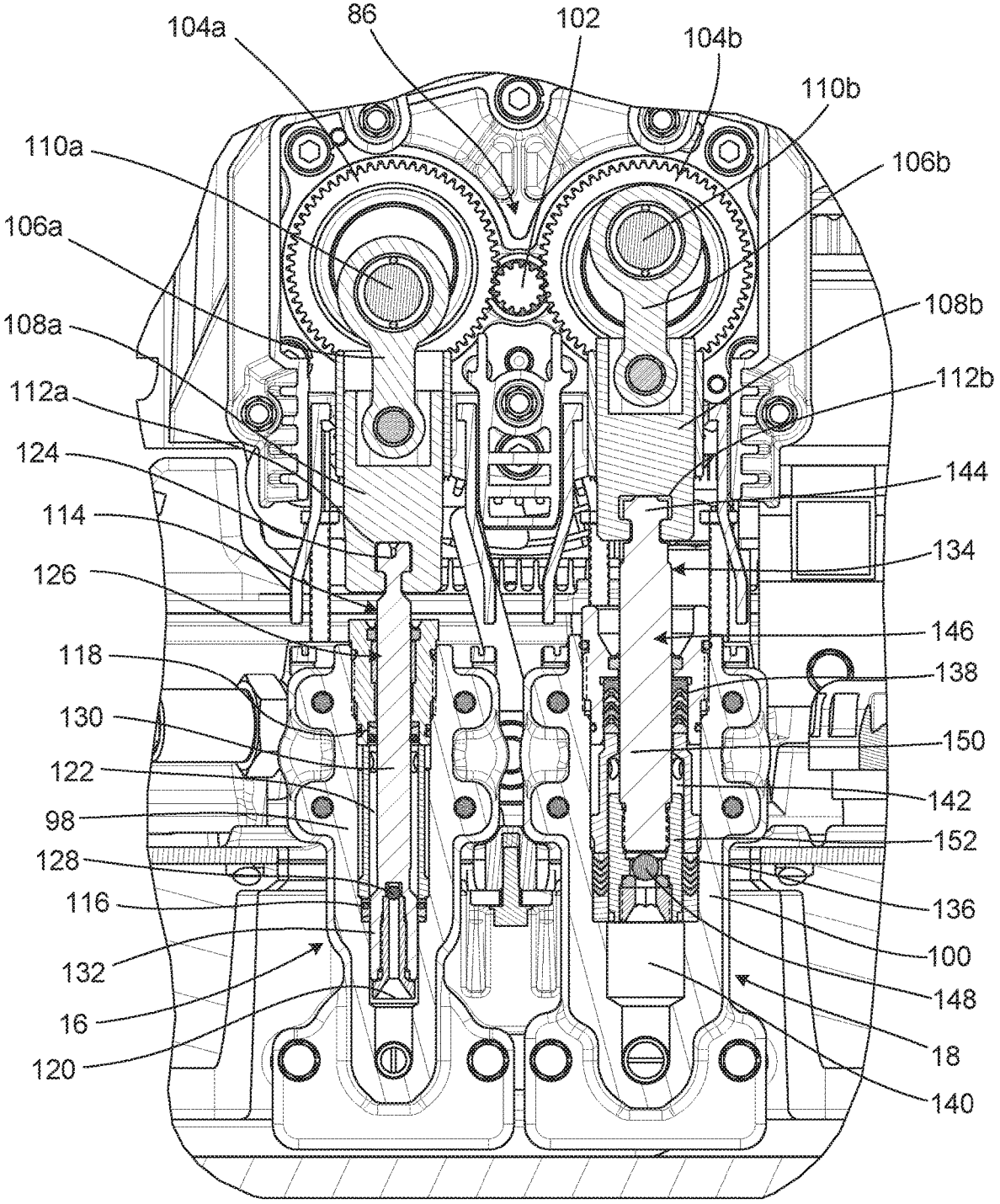
FIG. 3 is a cross-sectional view of the pumps of the hydraulic power unit taken along line 3-3 in FIG. 2A.

FIG. 3 is a cross-sectional view taken along line 3-3 in FIG. 2A. Drive mechanism 86 includes pinion 102, drive gear 104*a*, drive gear 104*b*, connecting rod 106*a*, connecting rod 106*b*, collar 108*a*, and collar 108*b*. Drive gear 104*a* includes eccentric drive pin 110*a*. Drive gear 104*b* includes eccentric drive pin 110*b*. Collar 108*a* includes slot 112*a*, and collar 108*b* includes slot 112*b*. Pump 16 includes cylinder body 98, piston 114, first dynamic seal 116, second dynamic seal 118, upstream fluid chamber 120, and downstream fluid chamber 122. Piston 114 includes piston head 124, piston rod 126, and piston valve 128. Piston rod 126 includes first diameter portion 130 and second diameter portion 132. Pump 18 includes cylinder body 100, piston 134, first dynamic seal 136, second dynamic seal 138, upstream fluid chamber 140, and downstream fluid chamber 142. Piston 134 includes piston head 144, piston rod 146, and piston valve 148. Piston rod 146 includes first diameter portion 150 and second diameter portion 152.

Pinion 102 is driven by a motor, such as motor 84 (FIGS. 2A-2B), and interfaces with both drive gear 104*a* and drive gear 104*b*. As such, pinion 102 drives both drive gear 104*a* and drive gear 104*b* simultaneously and at the same speed. Connecting rod 106*a* is mounted on eccentric drive pin 110*a*, and collar 108*a* is attached to connecting rod 106*a*. Connecting rod 106*a* and eccentric drive pin 110*a* convert the rotational output of drive gear 104*a* into linear, reciprocating motion of collar 108*a*. Connecting rod 106*b* is mounted on eccentric drive pin 110*b*, and collar 108*b* is attached to connecting rod 106*b*. Connecting rod 106*b* and eccentric drive pin 110*b* convert the rotational output of drive gear 104*b* into linear, reciprocating motion of collar 108*b*.

Cylinder body 98 is directly mounted on fluid tank 92 and valve manifold 42. In some examples, cylinder body 98 can be formed from a metal, such as aluminum or steel. Piston 114 is disposed at least partially within cylinder body 98 and is configured to drive the hydraulic fluid through pump 16. Piston head 124 is disposed outside of cylinder body 98 and is mounted in slot 112*a* of collar 108*a*. Slot 112*a* is open through both a bottom portion of collar 108*a* and a front portion of collar 108*a* to receive piston head 124. Collar 108*a* drives piston 114 in a linear, reciprocating manner through the connection of piston head 124 and slot 112*a*. Piston head 124 is configured to slide into and out of slot 112*a* during mounting and dismounting of pump 16 on HPU 10. Piston rod 126 extends from piston head 124 into cylinder body 98.

Cylinder body 100 is directly mounted on fluid tank 92 and valve manifold 42. In some examples, cylinder body 100 can be formed from a metal, such as aluminum or steel. Piston 134 is disposed at least partially within cylinder body 100 and is configured to drive the hydraulic fluid through pump 18. Piston head 144 is mounted in slot 112*b* of collar 108*b*. Slot 112*b* is open through both a bottom portion of collar 108*b* and a front portion of collar 108*b* to receive piston head 144. Collar 108*b* drives piston 134 in a linear, reciprocating manner through the connection of piston head 144 and slot 112*b*. Piston head 144 is configured to slide into and out of slot 112*b* during mounting and dismounting of pump 18 on HPU 10. Piston rod 146 extends from piston head 144 into cylinder body 100.

Eccentric drive pin 110*a* and eccentric drive pin 110*b* are offset circumferentially such that piston 114 moves out of phase with piston 134. In some examples, piston 114 moves 180-degrees out of phase with piston 134. As such, when piston 114 is moving through an upstroke piston 134 is moving through a downstroke, and when piston 114 is moving through a downstroke piston 134 is moving through an upstroke.

Piston valve 128 is disposed within piston 114. Piston valve 128 is shown as a ball and seat check valve, but it is understood that any suitable check valve can be disposed within piston 114. Upstream fluid chamber 120 is disposed within cylinder body 98 on an upstream side of piston 114. Downstream fluid chamber 122 is disposed between first diameter portion 130 of piston rod 126 and an inner surface of cylinder body 98. First dynamic seal 116 is disposed between the inner surface of cylinder body 98 and second diameter portion 132 of piston rod 126. First dynamic seal 116 separates upstream fluid chamber 120 from downstream fluid chamber 122. Second dynamic seal 118 disposed between the inner cylindrical surface of cylinder body 98 and first diameter portion 130 of piston rod 126. Piston 114 is configured to move relative to first dynamic seal 116 and second dynamic seal 118 during reciprocation. It is understood, however, that one or both of first dynamic seal 116 and second dynamic seal 118 can be mounted on piston 114 to move relative to cylinder body 98. In some examples, first dynamic seal 116 and second dynamic seal 118 are energized u-cup rings. It is understood, however, that first dynamic seal 116 and second dynamic seal 118 can be of any desired configuration, such as alternating leather and polyurethane packing rings.

Piston valve 148 is disposed within piston 134. Piston valve 148 is shown as a ball and seat check valve, but it is understood that any suitable check valve can be disposed within piston 134. Upstream fluid chamber 140 is disposed within cylinder body 100 on an upstream side of piston 134. Downstream fluid chamber 142 is disposed between first diameter portion 150 of piston rod 146 and an inner surface of cylinder body 100. First dynamic seal 136 is disposed between the inner surface of cylinder body 100 and second diameter portion 152 of piston rod 146. First dynamic seal 136 separates upstream fluid chamber 140 from downstream fluid chamber 142. Second dynamic seal 138 disposed between the inner cylindrical surface of cylinder body 100 and first diameter portion 150 of piston rod 146. First diameter portion 150 has a larger diameter than second diameter portion 152. As shown, first diameter portion 150 is formed separately from and attached to second diameter portion 152. It is understood, however, that first diameter portion 150 can be unitarily formed with second diameter portion 152. Piston 134 is configured to move relative to first dynamic seal 136 and second dynamic seal 138 during reciprocation. It is understood, however, that one or both of first dynamic seal 136 and second dynamic seal 138 can be mounted on piston 134 to move relative to cylinder body 100. In some examples, first dynamic seal 136 and second dynamic seal 138 include alternating leather and polyurethane packing rings. It is understood, however, that first dynamic seal 116 and second dynamic seal 118 can be of any desired configuration, such as energized u-cup seals.

During operation, piston 114 is driven in a linear, reciprocating manner by drive mechanism 86. During an upstroke, the hydraulic fluid in downstream fluid chamber 122 forces piston valve 128 closed, such that the hydraulic fluid in downstream fluid chamber 122 is prevented from backflowing into upstream fluid chamber 120. Second diameter portion 132 reduces the volume of downstream fluid chamber 122 as piston 114 is pulled through the upstroke, and second diameter portion 132 drives the hydraulic fluid downstream out of downstream fluid chamber 122. The upstroke also increases the volume of upstream fluid chamber 120, creating a suction condition that draws the hydraulic fluid into upstream fluid chamber 120 from fluid tank 92. During a downstroke, the hydraulic fluid in upstream fluid chamber 120 causes piston valve 128 to shift to an open state. The hydraulic fluid in upstream fluid chamber 120 flows into second diameter portion 132, through piston valve 128, and into downstream fluid chamber 122. The hydraulic fluid flowing into downstream fluid chamber 122 during the downstroke also flows downstream out of downstream fluid chamber 122. As such, pump 16 outputs a flow of hydraulic fluid during both the upstroke and the downstroke.

Similar to piston 114, piston 134 is driven in a linear, reciprocating manner by drive mechanism 86. During an upstroke, the hydraulic fluid in downstream fluid chamber 142 forces piston valve 148 closed, such that the hydraulic fluid in downstream fluid chamber 142 is prevented from backflowing into upstream fluid chamber 140. Second diameter portion 152 reduces the volume of downstream fluid chamber 142 to drive the hydraulic fluid downstream out of downstream fluid chamber 142. The upstroke also increases the volume of upstream fluid chamber 140, creating a suction condition that draws the hydraulic fluid into upstream fluid chamber 140 from fluid tank 92. During a downstroke, the hydraulic fluid in upstream fluid chamber 140 causes piston valve 148 to shift to an open state. The hydraulic fluid in upstream fluid chamber 140 flows into second diameter portion 152, through piston valve 148, and into downstream fluid chamber 142. The hydraulic fluid flowing into downstream fluid chamber 142 during the downstroke also flows downstream out of downstream fluid chamber 142. As such, pump 18 outputs a flow of hydraulic fluid during both the upstroke and the downstroke.

Pump 18 has a higher volumetric output compared to pump 16. Upstream fluid chamber 140 has a larger volume than upstream fluid chamber 120, and downstream fluid chamber 142 has a larger volume than downstream fluid chamber 142. In addition, first diameter portion 150 has a larger diameter than first diameter portion 130, and second diameter portion 152 has a larger diameter than second diameter portion 132. The relatively larger diameters of cylinder body 100 and piston 134 as compared to cylinder body 98 and piston 114 provide pump 18 with a relatively larger displacement than pump 16. Pump 16 provides outputs at a relatively higher pressure than pump 18 due to the smaller displacement of pump 16 as compared to pump 18.

Pump 16 and pump 18 are each double displacement pumps, which provides significant advantages. Pump 16 and pump 18 being double displacement pumps reduces pressure pulsation at lower pump cycle rates, which allows motor 84 to be run at slower speeds while maintaining smooth pressure delivery. Running motor 84 at lower speeds reduces power demands and reduces wear on HPU 10, and thereby maintenance costs.

Figure 4:
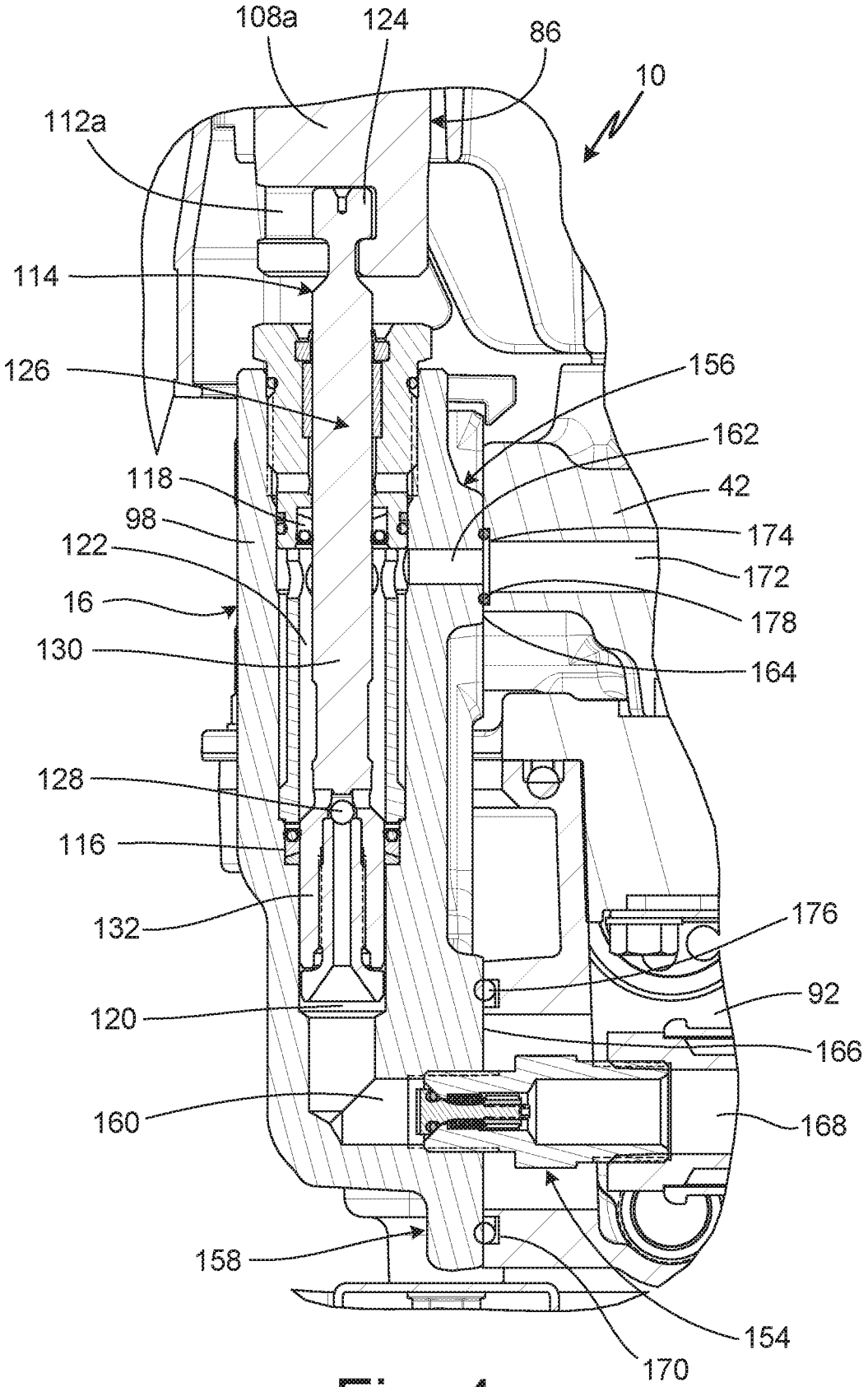
FIG. 4 is a side cross-sectional view showing a connection of a first pump and a hydraulic power unit.

FIG. 4 is a side cross-sectional view of pump 16 showing the connection of pump 16 and HPU 10. Pump 16, valve manifold 42, fluid tank 92, and inlet valve 154 of HPU 10 are shown. Collar 108*a* of drive mechanism 86 is shown, and collar 108*a* includes slot 112*a*. Pump 16 includes cylinder body 98, piston 114, first dynamic seal 116, second dynamic seal 118, upstream fluid chamber 120, and downstream fluid chamber 122. Piston 114 includes piston head 124, piston rod 126, and piston valve 128. Piston rod 126 includes first diameter portion 130 and second diameter portion 132. Cylinder body 98 includes upper mounting portion 156, lower mounting portion 158, fluid inlet 160, and fluid outlet 162. Upper mounting portion 156 includes upper face 164. Lower mounting portion 158 includes lower face 166. Fluid tank 92 includes supply port 168 and tank seal groove 170. Valve manifold 42 includes receiving port 172 and manifold seal groove 174.

Cylinder body 98 is mounted on an exterior fluid tank 92 and an exterior of valve manifold 42. Lower mounting portion 158 is attached to fluid tank 92 with lower face 166 abutting fluid tank 92. Lower face 166 is a flat surface. Lower seal 176 is disposed in tank seal groove 170 between lower face 166 and fluid tank 92. Lower seal 176 can be any suitable seal for sealing the interface between lower face 166 and fluid tank 92. In some examples, lower seal 176 is an o-ring, such as an elastomer o-ring. Supply port 168 extends within fluid tank 92 and is aligned with fluid inlet 160 in cylinder body 98. In some examples, supply port 168 is at least a portion of first pump supply line 56 (FIG. 1). Fluid inlet 160 receive the hydraulic fluid from supply port 168. Fluid inlet 160 includes a 90-degree bend between inlet valve 154 and upstream fluid chamber 120 to turn the hydraulic fluid from supply port 168 into upstream fluid chamber 120.

Inlet valve 154 extends from supply channel into fluid inlet 160. Inlet valve 154 is a normally-closed valve, and inlet valve 154 is configured to prevent the hydraulic fluid from backflowing into fluid tank 92 from fluid inlet 160 and upstream fluid chamber 120. During an upstroke of piston 114, the suction generated in upstream fluid chamber 120 causes inlet valve 154 to shift to an open state such that the hydraulic fluid can flow from supply port 168 into fluid inlet 160. As shown, inlet valve 154 is a poppet valve. It is understood, however, that any suitable style of check valve for preventing backflow from fluid inlet 160 can be used. For example, inlet valve 154 can be a ball check valve that includes a spring to bias the ball towards a closed state.

Upper mounting portion 156 is attached to valve manifold 42 with upper face 164 abutting valve manifold 42. Upper face 164 is a flat surface. Upper seal 178 is disposed in manifold seal groove 174 between upper face 164 and valve manifold 42. Upper seal 178 can be any suitable seal for sealing the interface between upper mounting portion 156 and valve manifold 42. In some examples, upper seal 178 is an o-ring, such as an elastomer o-ring. Receiving port 172 extends within valve manifold 42 and forms a portion of high-pressure line 60 (FIG. 1). Fluid outlet 162 extends through upper face 164 and is aligned with receiving port 172. Fluid outlet 162 is configured to supply the hydraulic fluid from downstream fluid chamber 122 to supply port 168.

During operation, piston 114 is driven in a linear, reciprocating manner by collar 108*a*, due to the connection of piston head 124 and slot 112*a*. During an upstroke of piston 114, piston valve 128 is forced into a closed state by the hydraulic fluid in downstream fluid chamber 122. Second diameter portion 132 of piston rod 126 drives the hydraulic fluid downstream out of downstream fluid chamber 122, to fluid outlet 162, and into receiving port 172 of valve manifold 42. Simultaneously, a suction condition is created in upstream fluid chamber 120, which causes inlet valve 154 to shift open and draws hydraulic fluid into upstream fluid chamber 120 from fluid tank 92 through supply port 168, inlet valve 154, and fluid inlet 160. During a downstroke of piston 114, second diameter portion 132 moves downward into upstream fluid chamber 120, and the hydraulic fluid in upstream fluid chamber 120 causes piston valve 128 to shift to an open state. Inlet valve 154 returns to a closed state. The hydraulic fluid in upstream fluid chamber 120 flows through piston valve 128 into downstream fluid chamber 122, and continues to flow downstream to fluid outlet 162 and receiving port 172.

Fluid inlet 160, upper face 164, lower face 166, and piston 114 facilitate quick mounting of pump 16 on an exterior of HPU 10. Upper face 164 and lower face 166 are flat surfaces that abut flat surfaces on valve manifold 42 and fluid tank 92, respectively. Upper seal 178 is the only seal required at the interface of upper face 164 and valve manifold 42. Lower seal 176 is the only seal required at the interface of lower face 166 and fluid tank 92. As such, installation of cylinder body 98 on HPU 10 involves positioning upper seal 178 in manifold seal groove 174, positioning lower seal 176 in tank seal groove 170, and positioning cylinder body 98 on and attaching cylinder body 98 to valve manifold 42 and fluid tank 92. In addition, piston 114 connects with collar 108*a* by sliding piston head 124 into slot 112*a*. As such, installation of cylinder body 98 does not involve complicating seal arrangements or attachments. Fluid inlet 160 includes the 90-degree bend, which turns the fluid from supply port 168 into upstream fluid chamber 120, allowing pump 16 to be mounted vertically on the exterior of HPU 10.

Figure 5:
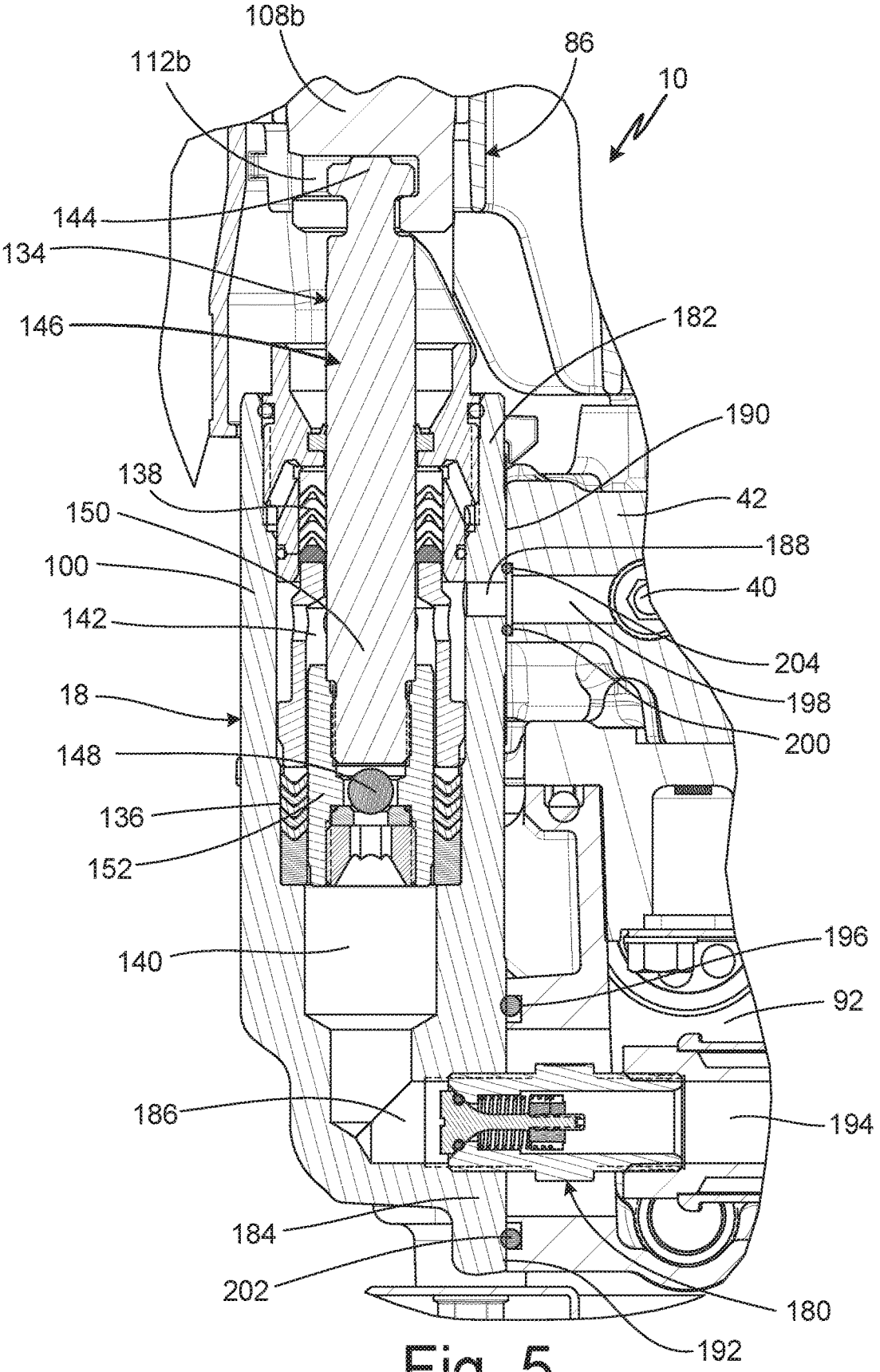
FIG. 5 is a side cross-sectional view showing a connection of a second pump and a hydraulic power unit.

FIG. 5 is a side cross-sectional view showing the connection of pump 18 and HPU 10. Pump 18, second check valve 40, valve manifold 42, fluid tank 92, and inlet valve 180 of HPU 10 are shown. Collar 108*b* of drive mechanism 86 is shown, and collar 108*b* includes slot 112*b*. Pump 18 includes cylinder body 100, piston 134, first dynamic seal 136, second dynamic seal 138, upstream fluid chamber 140, and downstream fluid chamber 142. Piston 134 includes piston head 144, piston rod 146, and piston valve 148. Piston rod 146 includes first diameter portion 150 and second diameter portion 152. Cylinder body 100 includes upper mounting portion 182, lower mounting portion 184, fluid inlet 186, and fluid outlet 188. Upper mounting portion 182 includes upper face 190. Lower mounting portion 184 includes lower face 192. Fluid tank 92 includes supply port 194 and tank seal groove 196. Valve manifold 42 includes receiving port 198 and manifold seal groove 200.

Cylinder body 100 of pump 18 is mounted on an exterior of fluid tank 92 and an exterior of valve manifold 42. Lower mounting portion 184 is attached to fluid tank 92 with lower face 192 abutting fluid tank 92*b*. Lower face 192 is a flat surface. Lower seal 202 is disposed in tank seal groove 196 between lower face 192 and fluid tank 92. Lower seal 202 can be any suitable seal for sealing the interface between lower mounting portion 184 and fluid tank 92. For example, lower seal 202 can be an o-ring, such as an elastomer o-ring. Supply port 194 extends within fluid tank 92 and is aligned with fluid inlet 186 in cylinder body 100. In some examples, supply port 194 is at least a portion of second pump supply line 58 (FIG. 1). Fluid inlet 186 receives the hydraulic fluid from supply port 194. Fluid inlet 186 includes a 90-degree bend between inlet valve 180 and upstream fluid chamber 140 to turn the hydraulic fluid into upstream fluid chamber 140.

Inlet valve 180 extends from supply port 194 and into fluid inlet 186. Inlet valve 180 is a normally-closed valve, and is configured to prevent the hydraulic fluid from backflowing into fluid tank 92 from fluid inlet 186 and upstream fluid chamber 140. During an upstroke of piston 134, the suction generated in upstream fluid chamber 140 causes inlet valve 180 to shift to an open state such that the hydraulic fluid can flow from supply port 194 into fluid inlet 186. As shown, inlet valve 180 is a poppet valve. It is understood, however, that any suitable style of check valve for preventing backflow out of fluid inlet 186 can be used. For example, inlet valve 180 can be a ball check valve that has a spring to bias the ball towards a closed state.

Upper mounting portion 182 is attached to valve manifold 42 with upper face 190 abutting valve manifold 42. Upper face 190 is a flat surface. Upper seal 204 is disposed in manifold seal groove 200 between upper face 190 and valve manifold 42. Upper seal 204 can be any suitable seal for sealing the interface between upper mounting portion 182 and valve manifold 42. For example, upper seal 204 can be an o-ring, such as an elastomer o-ring. Receiving port 198 extends within valve manifold 42 and forms a portion of high-flow line 62 (FIG. 1). Fluid outlet 188 is aligned with receiving port 198 and is configured to supply the hydraulic fluid from downstream fluid chamber 142 to supply port 194. Second check valve 40 is disposed in receiving port 198 and is configured to prevent hydraulic fluid from backflowing to pump 18.

During operation, piston 134 is driven in a linear, reciprocating manner by collar 108*b*, due to the connection of piston head 144 and slot 112*b*. During an upstroke of piston 134, piston valve 148 is forced into a closed state by the hydraulic fluid in downstream fluid chamber 142. Second diameter portion 152 of piston rod 146 drives the hydraulic fluid downstream out of downstream fluid chamber 142, to fluid outlet 188, and into receiving port 198 of valve manifold 42. Simultaneously, a suction condition is created in upstream fluid chamber 140, which causes inlet valve 180 to shift open and draws hydraulic fluid into upstream fluid chamber 140 from fluid tank 92 through supply port 194, inlet valve 180, and fluid inlet 186. During a downstroke of piston 134, second diameter portion 152 moves downward into upstream fluid chamber 140, and the hydraulic fluid in upstream fluid chamber 140 causes piston valve 148 to shift to an open state. Inlet valve 180 returns to a closed state. The hydraulic fluid in upstream fluid chamber 140 flows through piston valve 148 into downstream fluid chamber 142, and continues to flow downstream to fluid outlet 188 and receiving port 198.

Fluid inlet 186, upper face 190, lower face 192, and piston 134 facilitate quick mounting of pump 18 on an exterior of HPU 10. Upper face 190 and lower face 192 are flat surfaces that abut flat surfaces on valve manifold 42 and fluid tank 92, respectively. Upper seal 204 is the only seal required at the interface of upper face 190 and valve manifold 42. Lower seal 202 is the only seal required at the interface of lower face 192 and fluid tank 92. As such, installation of cylinder body 100 on HPU 10 involves positioning upper seal 204 in manifold seal groove 200, positioning lower seal 202 in tank seal groove 196, and positioning cylinder body 100 on and attaching cylinder body 100 to valve manifold 42 and fluid tank 92. In addition, piston 134 connects with collar 108*b* by sliding piston head 144 into slot 112*b*. As such, installation of cylinder body 100 does not involve complicating seal arrangements or attachments. Fluid inlet 186 includes the 90-degree bend, which turns the fluid from supply port 194 into upstream fluid chamber 140, allowing pump 18 to be mounted vertically on the exterior of HPU 10.

Figure 6A:
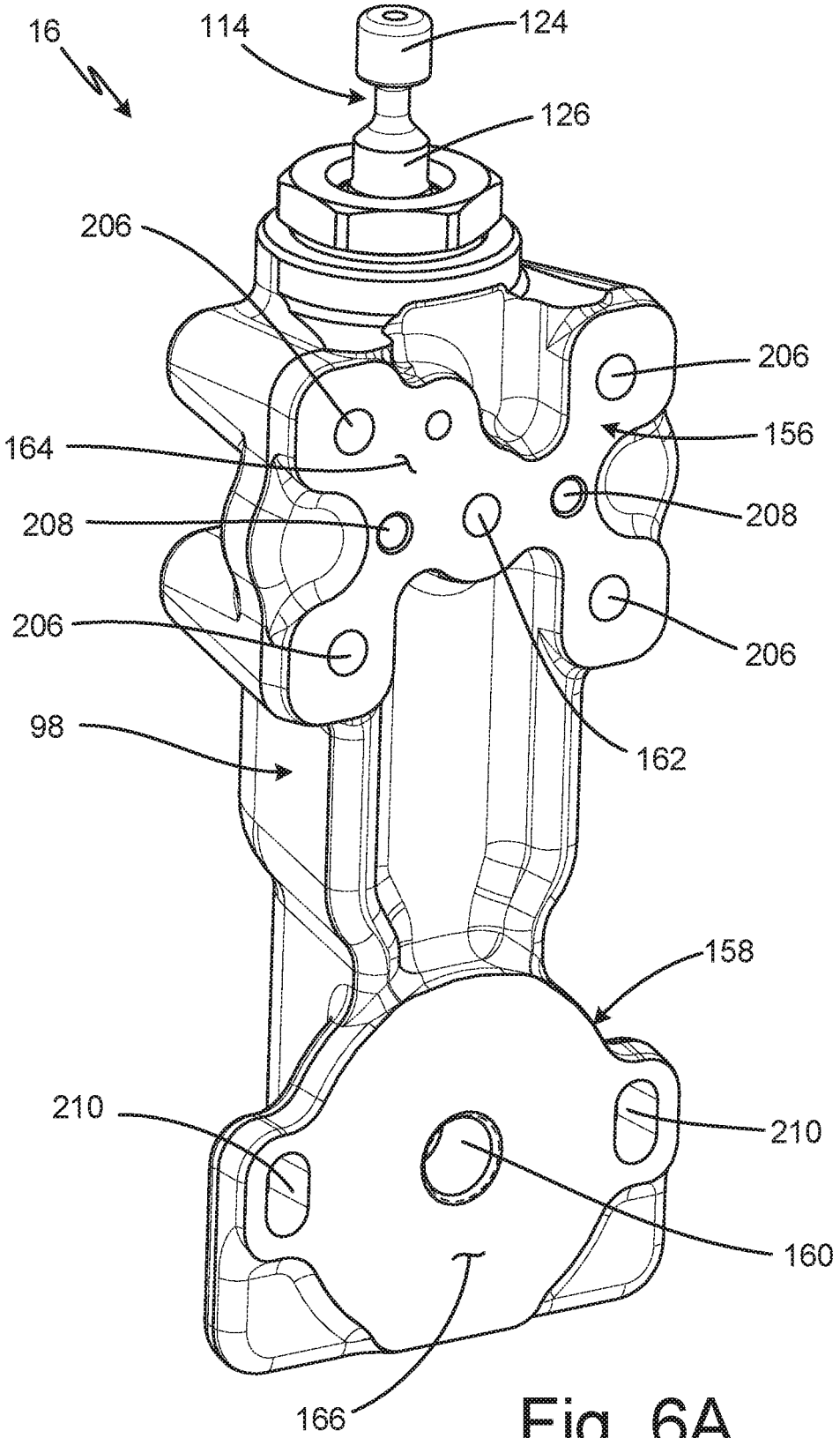
FIG. 6A is a rear isometric view of a pump.
Figure 6B:
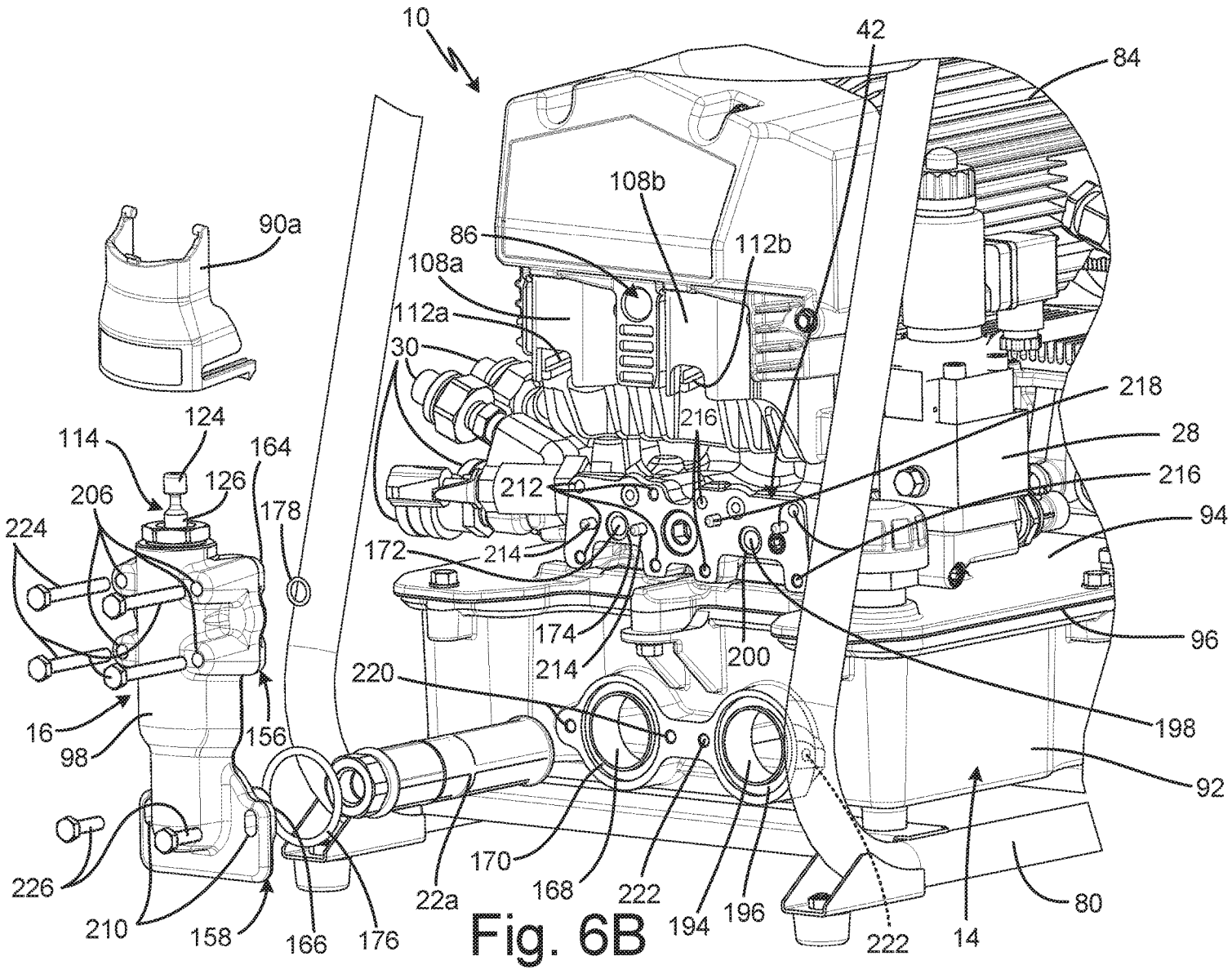
FIG. 6B is a partially exploded view of the hydraulic power unit.

FIG. 6A is a rear isometric view of pump 16. FIG. 6B is a partially exploded view of HPU 10 and pump 16, with pump 18 (best seen in FIGS. 3B, 5, and 7) removed. Fluid reservoir 14, pump 16, strainer 22*a*, four-way valve 28, fluid ports 30, valve manifold 42, frame 80, motor 84, drive mechanism 86, first cover 90*a*, lower seal 176, and upper seal 178 of HPU 10 are shown. Fluid reservoir 14 includes fluid tank 92, lid 94, and gasket 96. Cylinder body 98 and piston 114 of pump 16 are shown. Cylinder body 98 includes upper mounting portion 156, lower mounting portion 158, fluid inlet 160 (FIG. 6A), and fluid outlet 162 (FIG. 6A). Upper mounting portion 156 includes upper face 164, upper fastener openings 206, and alignment openings 208 (FIG. 6A). Lower mounting portion 158 includes lower face 166 and lower fastener openings 210. Piston head 124 and piston rod 126 of piston 114 are shown. Collar 108*a* and collar 108*b* of drive mechanism 86 are shown. Collar 108*a* includes slot 112*a*, and collar 108*b* includes slot 112*b*. Valve manifold 42 includes receiving port 172, manifold seal groove 174, receiving port 198, manifold seal groove 200, upper threaded openings 212, alignment pins 214, upper threaded openings 216, and alignment pins 218. Fluid tank 92 includes supply port 168, tank seal groove 170, supply port 194, tank seal groove 196, lower threaded openings 220, and lower threaded openings 222.

Frame 80 supports other components of HPU 10. Motor 84 powers drive mechanism 86. Drive mechanism 86 is connected to and drives both pump 16 and pump 18. Fluid tank 92 is configured to store a supply of hydraulic fluid. Supply port 168 and supply port 194 extend into fluid tank 92. Tank seal groove 170 extends around supply port 168 and is configured to receive lower seal 176. Strainer 22*a* extends into supply port 168 and is configured to filter any contaminants from the hydraulic fluid prior to the hydraulic fluid entering pump 16. Lower threaded openings 220 extend into fluid tank 92 proximate supply port 168. Lid 94 is attached to and encloses fluid tank 92. Gasket 96 is disposed between fluid tank 92 and lid 94.

Valve manifold 42 is mounted above fluid tank 92 and is configured to route the hydraulic fluid from pump 16 to four-way valve 28. Fluid ports 30 extend out of valve manifold 42 and are configured to route hydraulic fluid to and from a hydraulically-driven tool, such as tool 74 (shown in FIG. 1), tool 74' (shown in FIG. 9A), and tool 74" (shown in FIG. 9B). Receiving port 172 extends into valve manifold 42. Manifold seal groove 174 extends around receiving port 172 and is configured to receive upper seal 178. Upper threaded openings 212 extend into valve manifold 42. Alignment pins 214 and alignment pins 218 extend from valve manifold 42. Alignment pins 214 are configured to be received by alignment openings 208 that extend into upper mounting portion 156 through upper face 164. Alignment pins 214 ensure that upper fastener openings 206 are aligned with upper threaded openings 212 and that lower fastener openings 210 are aligned with lower threaded openings 220 when pump 16 is installed on HPU 10. Alignment pins 214 are vertically offset from alignment pins 218 to prevent pump 16 from being inadvertently installed in the position of pump 18. If pump 16 is positioned on alignment pins 218, upper fastener openings 206 will be misaligned with upper threaded openings 216 and lower fastener openings 210 will be misaligned with lower threaded openings 222, such that pump 16 cannot be secured to valve manifold 42 and fluid tank 92.

Pump 16 is mounted on an exterior of HPU 10 and is connected to both valve manifold 42 and fluid tank 92. Upper mounting portion 156 interfaces with valve manifold 42. Upper face 164 is a flat surface that abuts valve manifold 42*a*. Upper fastener openings 206 extend through upper mounting portion 156. Upper fasteners 224 extend through upper fastener openings 206 and into upper threaded openings 212. Upper fasteners 224 include threading configured to interface with the threading in upper threaded openings 212. While upper threaded openings 212 are described as threaded openings, it is understood that upper threaded openings 212 and upper fasteners 224 can interface in any desired manner to secure upper mounting portion 156 to valve manifold 42, such as a detent connection. Upper seal 178 is disposed in manifold seal groove 174 between upper face 164 and valve manifold 42.

Lower mounting portion 158 interfaces with fluid tank 92. Lower face 166 is a flat surface that abuts fluid tank 92. Lower fastener openings 210 extend through lower mounting portion 158. Lower fasteners 226 extend through lower fastener openings 210 and into lower threaded openings 220. Lower fasteners 226 include threading configured to interface with the threading in lower threaded openings 220. While lower threaded openings 220 are described as threaded openings, it is understood that lower threaded openings 220 and lower fasteners 226 can interface in any desired manner to secure lower mounting portion 158 to fluid tank 92, such as a detent connection. Lower seal 176 is disposed in tank seal groove 170 between lower face 166 and fluid tank 92*a*.

Piston 114 extends at least partially out of cylinder body 98. Piston head 124 is configured to slide into slot 112*a* of collar 108*a*, such that collar 108*a* drives piston 114 in a linear, reciprocating manner due to the connection of piston head 124 in slot 112*a*. Second cover 90*a* encloses the connection of piston 114 and collar 108*a*.

To uninstall pump 16 from HPU 10, first cover 90*a* is removed to expose the connection of piston 114 and collar 108*a*. While first cover 90*a* is shown as completely removed from HPU 10, it is understood that first cover 90*a* can pivot with respect to HPU 10 to expose the connection of piston 114 and collar 108*a*. Upper fasteners 224 are unthreaded from upper threaded openings 212, and lower fasteners 226 are unthreaded from lower threaded openings 220. With upper fasteners 224 and lower fasteners 226 removed, pump 16 can be pulled away from HPU 10 with a simple sliding motion. The sliding motion breaks four connections between pump 16 and HPU 10. Specifically, the sliding motion breaks the dynamic mechanical connection between piston head 124 and slot 112*a* of collar 108*a*, the static structural connection between cylinder body 98 and valve manifold 42 and fluid tank 92, the fluid connection between supply port 168 and fluid inlet 160, and the fluid connection between fluid outlet 162 and receiving port 172. As such, removing cylinder body 98 breaks a dynamic mechanical connection, a static structural connection, and two fluid connections. In some examples, strainer 22*a* is attached to cylinder body 98 such that strainer 22*a* is removed from fluid tank 92*a* when pump 16 is removed.

Pump 16 is installed on HPU 10 by reversing the process for uninstalling pump 16. Upper seal 178 is positioned in manifold seal groove 174 and lower seal 176 is positioned in tank seal groove 170. Pump 16 is slid onto HPU 10 such that alignment pins 214 are received in alignment openings 208 and piston head 124 is disposed in slot 112*a* of collar 108*a*. With pump 16 disposed on HPU 10, upper fasteners 224 are inserted through upper fastener openings 206 and threaded into upper threaded openings 212, and lower fasteners 226 are inserted through lower fastener openings 210 and threaded into lower threaded openings 220. All four connections; the dynamic mechanical connection, the static structural connection, and the two fluid connections; between pump 16 and HPU 10 are thus established.

The connection of pump 16 and HPU 10 provides significant advantages. Alignment pins 214 ensure that pump 16 is correctly positioned on HPU 10. Alignment pins 214 and alignment pins 218 prevent pump 16 and pump 18 from being installed at incorrect locations on HPU 10. All of the mechanical and fluid connections between pump 16 and HPU 10 can be established by simply sliding pump 16 onto HPU 10 and attaching pump 16 with upper fasteners 224 and lower fasteners 226. All of the mechanical and fluid connections can be broken by removing upper fasteners 224 and lower fasteners 226 and sliding pump 16 off of HPU 10. Pump 16 is mounted on an exterior of HPU 10 such that pump 16 can be removed and serviced without having to remove lid 94 from fluid tank 92, which provides quicker, more efficient servicing. Servicing an in-tank pump requires removal of lid 94 and exposes the inside of fluid tank 92 and the hydraulic fluid to contamination. In addition, in-tank pumps are typically submerged in the hydraulic fluid, which leads to messier and more complicated servicing. Gasket 96 is also difficult to replace, particularly during in-field servicing, because gasket 96 has complicated geometry to match the geometry of fluid tank 92. As such, removing gasket 96 can cause leakage and require in-shop servicing. Moreover, the fluid connections between pump 16 and HPU 10 are sealed by two seals, upper seal 178 and lower seal 176, that provide easy and reliable sealing and prevent leakage of hydraulic fluid. Upper seal 178 and lower seal 176 are typically elastomer o-rings, which provide improved sealing and seating and a smaller surface area than gasket 96 between fluid tank 92 and lid 94. Moreover, no hoses are required to connect pump 16 with HPU 10, as cylinder body 98 is directly mounted to both fluid tank 92 and valve manifold 42, thereby providing increased reliability and decreased complexity.

Figure 7:
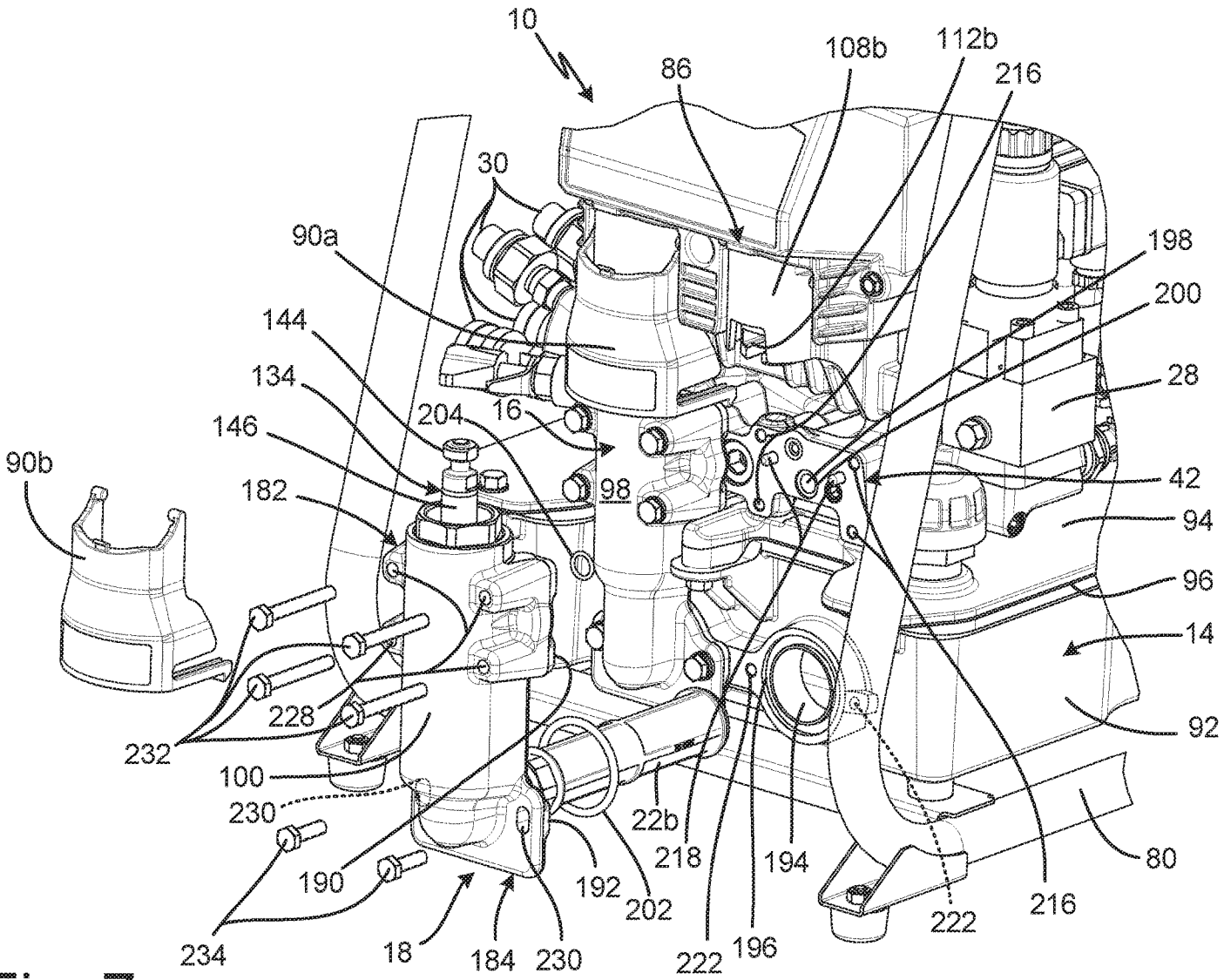
FIG. 7 is a partially exploded view of the hydraulic power unit.

FIG. 7 is a partially exploded view of HPU 10 and pump 18. Fluid reservoir 14, pump 16, pump 18, strainer 22*b*, four-way valve 28, fluid ports 30, valve manifold 42, frame 80, drive mechanism 86, first cover 90*a*, second cover 90*b*, lower seal 202, and upper seal 204 of HPU 10 are shown. Fluid reservoir 14 includes fluid tank 92, lid 94, and gasket 96. Cylinder body 98 of pump 16 is shown. Cylinder body 100 and piston 134 of pump 18 are shown. Cylinder body 100 includes upper mounting portion 182 and lower mounting portion 184. Upper mounting portion 182 includes upper face 190 and upper fastener openings 228. Lower mounting portion 184 includes lower face 192 and lower fastener openings 230. Piston head 144 and piston rod 146 of piston 134 are shown. Collar 108*b* of drive mechanism 86 is shown, and collar 108*b* includes slot 112*b*. Receiving port 198, manifold seal groove 200, upper threaded openings 216, and alignment pins 218 of valve manifold 42 are shown. Supply port 194, tank seal groove 196, and lower threaded openings 222 of fluid tank 92 are shown.

Frame 80 supports other components of HPU 10. Drive mechanism 86 is connected to and drives both pump 16 and pump 18. Fluid tank 92 is configured to store a supply of hydraulic fluid. Supply port 194 extends into fluid tank 92. Tank seal groove 196 extends around supply port 194 and is configured to receive lower seal 202. Strainer 22*b* extends into supply port 194 and is configured to filter any contaminants out of the hydraulic fluid prior to the hydraulic fluid entering pump 18. Lower threaded openings 222 extend into fluid tank 92 proximate supply port 194. Lid 94 is attached to and encloses fluid tank 92. Gasket 96 is disposed between fluid tank 92 and lid 94.

Valve manifold 42 is mounted above fluid tank 92 and is configured to route the hydraulic fluid from pump 16 to four-way valve 28 and the hydraulic fluid from pump 18 to four-way valve 28 and two-way valve 26 (shown in FIGS. 1, and 2C-2D). Fluid ports 30 extend out of valve manifold 42 and are configured to route hydraulic fluid to and from a hydraulically-driven tool, such as tool 74 (shown in FIG. 1), tool 74' (shown in FIG. 9A), and tool 74" (shown in FIG. 9B). Receiving port 198 extends into valve manifold 42.

Manifold seal groove 200 extends around receiving port 198 and is configured to receive upper seal 204. Upper threaded openings 216 extend into valve manifold 42. Alignment pins 218 extend from valve manifold 42. Alignment pins 218 are configured to be received by alignment openings (not shown) that extend into upper mounting portion 182 through upper face 190. Alignment pins 218 ensure that upper fastener openings 228 are aligned with upper threaded openings 216 and that lower fastener openings 230 are aligned with lower threaded openings 222 when pump 18 is installed on HPU 10.

Pump 18 is mounted on an exterior of HPU 10 and is connected to both valve manifold 42 and fluid tank 92. Upper mounting portion 182 interfaces with valve manifold 42. Upper face 190 is a flat surface that abuts valve manifold 42*b*. Upper fastener openings 228 extend through upper mounting portion 182. Upper fasteners 232 extend through upper fastener openings 228 and into upper threaded openings 216. Upper fasteners 232 include threading configured to interface with the threading in upper threaded openings 216. While upper threaded openings 216 are described as threaded openings, it is understood that upper threaded openings 216 and upper fasteners 232 can interface in any desired manner to secure upper mounting portion 182 to valve manifold 42, such as a detent connection. Upper seal 204 is disposed in manifold seal groove 200 between upper face 190 and valve manifold 42. Upper mounting portion 182 also includes alignment openings (not shown), similar to alignment openings 208 (FIG. 6A). However, the alignment openings of upper mounting portion 182 are disposed at a different position relative to fluid outlet 188 (FIG. 5) as compared to alignment openings 208 and fluid outlet 162 (FIGS. 4 and 6B), to prevent unintended installation of pump 18 at the location of pump 16.

Lower mounting portion 184 interfaces with fluid tank 92. Lower face 192 is a flat surface that abuts fluid tank 92. Lower fastener openings 230 extend through lower mounting portion 184. Lower fasteners 234 extend through lower fastener openings 230 and into lower threaded openings 222. Lower fasteners 234 include threading configured to interface with the threading in lower threaded openings 222. While lower threaded openings 222 are described as threaded openings, it is understood that lower threaded openings 222 and lower fasteners 234 can interface in any desired manner to secure lower mounting portion 184 to fluid tank 92, such as a detent connection. Lower seal 202 is disposed in tank seal groove 196 between lower face 192 and fluid tank 92.

Piston 134 extends at least partially out of cylinder body 100. Piston head 144 is configured to slide into slot 112*b* of collar 108*b*, such that collar 108*b* drives piston 134 in an linear, reciprocating manner due to the connection of piston head 144 in slot 112*b*. Second cover 90*b* encloses the connection of piston 134 and collar 108*b*.

To uninstall pump 18 from HPU 10, second cover 90*b* is removed to expose the connection of piston 134 and collar 108*b*. While second cover 90*b* is shown as completely removed from HPU 10, it is understood that second cover 90*b* can pivot with respect to HPU 10 to expose the connection of piston 134 and collar 108*b*. Upper fasteners 232 are unthreaded from upper threaded openings 216, and lower fasteners 234 are unthreaded from lower threaded openings 222. With upper fasteners 232 and lower fasteners 234 removed, pump 18 can be pulled away from HPU 10 with a simple sliding motion. The sliding motion breaks four connections between pump 18 and HPU 10. Specifically, the sliding motion breaks the dynamic mechanical connection between piston head 144 and slot 112*b* of collar 108*b*, the static structural connection between cylinder body 100 and valve manifold 42 and fluid tank 92, the fluid connection between supply port 194 and fluid inlet 186 (shown in FIG. 5B), and the fluid connection between fluid outlet 188 (shown in FIG. 5B) and receiving port 198. As such, removing cylinder body 100 breaks a dynamic mechanical connection, a static structural connection, and two fluid connections. In some examples, strainer 22*b* is attached to cylinder body 100 such that strainer 22*b* is removed from fluid tank 92*b* when pump 18 is removed.

Pump 18 is installed on HPU 10 by reversing the process for uninstalling pump 18. Upper seal 204 is positioned in manifold seal groove 200 and lower seal 202 is positioned in tank seal groove 196. Pump 18 is slid onto HPU 10 such that alignment pins 218 are received in the alignment openings extending into upper mounting portion 182, and piston head 144 is disposed in slot 112*b* of collar 108*b*. With pump 18 positioned on HPU 10, upper fasteners 232 are inserted through upper fastener openings 228 and threaded into upper threaded openings 216, and lower fasteners 234 are inserted through lower fastener openings 230 and threaded into lower threaded openings 222. All four connections; the dynamic mechanical connection, the static structural connection, and the two fluid connections; between pump 18 and HPU 10 are thus established.

The connection of pump 18 and HPU 10 provides significant advantages. Alignment pins 218 ensure that pump 18 is correctly positioned on HPU 10. All of the mechanical and fluid connections between pump 18 and HPU 10 can be established by simply sliding pump 18 onto HPU 10 and attaching pump 18 with upper fasteners 232 and lower fasteners 234. All of the mechanical and fluid connections can be broken by removing upper fasteners 232 and lower fasteners 234 and sliding pump 18 off of HPU 10. Pump 18 is mounted on an exterior of HPU 10 such that pump 18 can be removed and serviced without having to remove lid 94 from fluid tank 92, which provides quicker, more efficient servicing. Servicing an in-tank pump requires removal of lid 94 and exposes the inside of fluid tank 92 and the hydraulic fluid to contamination. In addition, in-tank pumps are typically submerged in the hydraulic fluid, which leads to messier and more complicated servicing. Gasket 96 is also difficult to replace, particularly during in-field servicing, because gasket 96 is a long gasket having complicated geometry to match the geometry of fluid tank 92. As such, removing and replacing gasket 96 can cause leakage and require in-shop servicing. Moreover, the fluid connections between pump 18 and HPU 10 are sealed by two seals, upper seal 204 and lower seal 202, that provide easy and reliable sealing and prevent leakage of hydraulic fluid. Upper seal 204 and lower seal 202 are typically elastomer o-rings, which provide improved sealing and seating and a smaller surface area than gasket 96 between fluid tank 92 and lid 94. Moreover, no hoses are required to connect pump 18 with HPU 10, as cylinder body 100 is directly mounted to both fluid tank 92 and valve manifold 42, thereby providing increased reliability and decreased complexity.

Figure 8A:
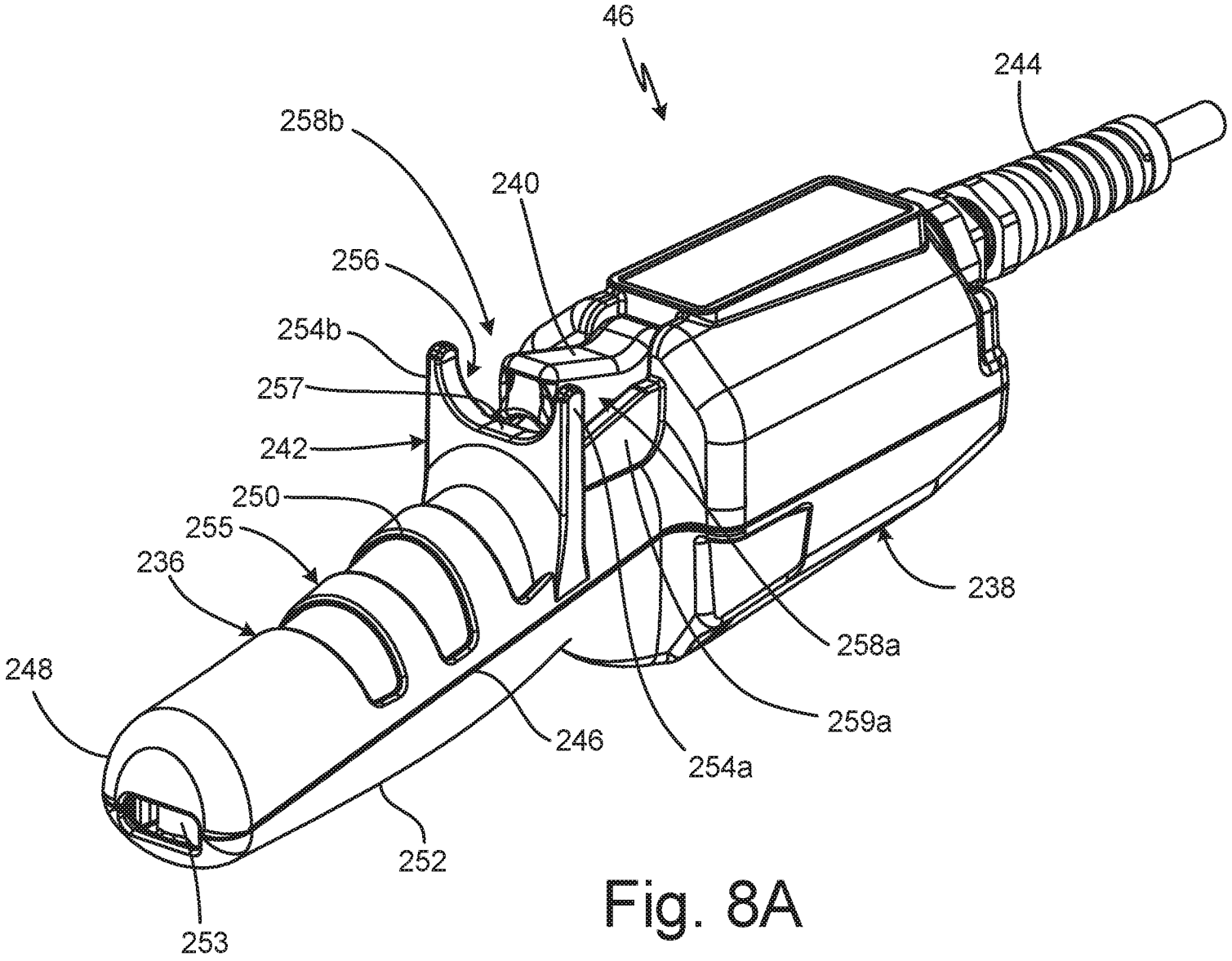
FIG. 8A is a first isometric view of a pendant.
Figure 8B:
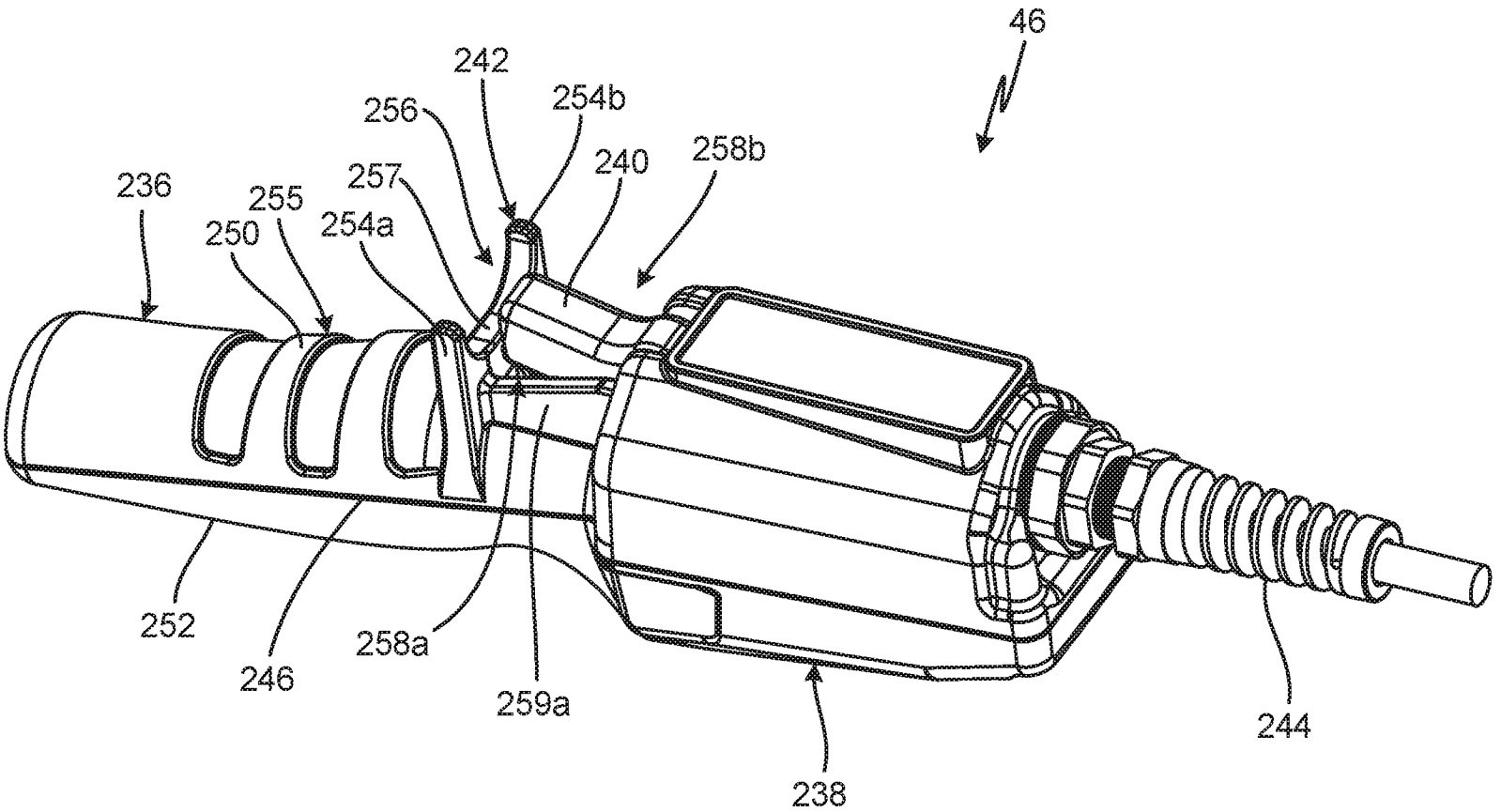
FIG. 8B is a second isometric view of the pendant.
Figure 8C:
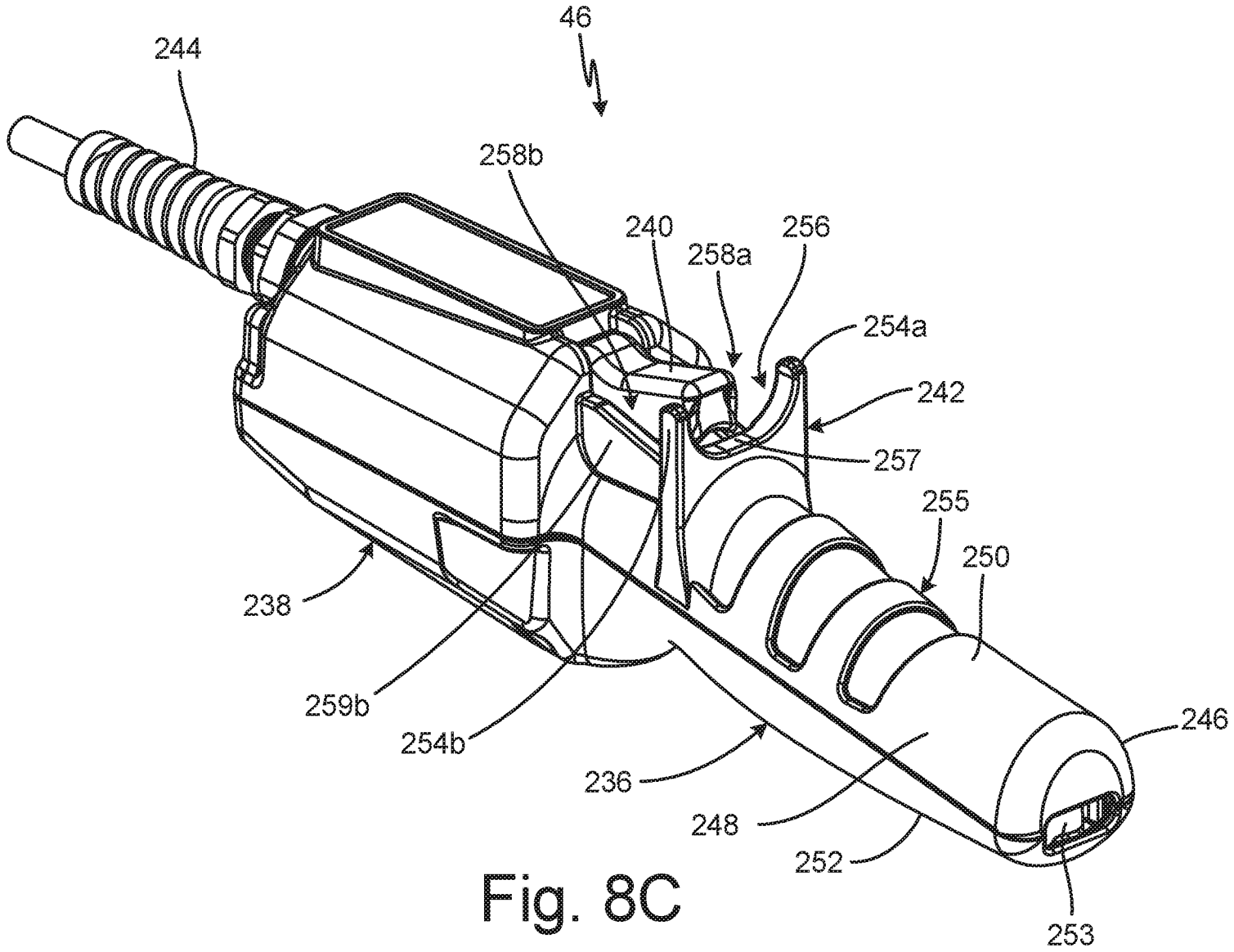
FIG. 8C is a third isometric view of the pendant.
Figure 8D:
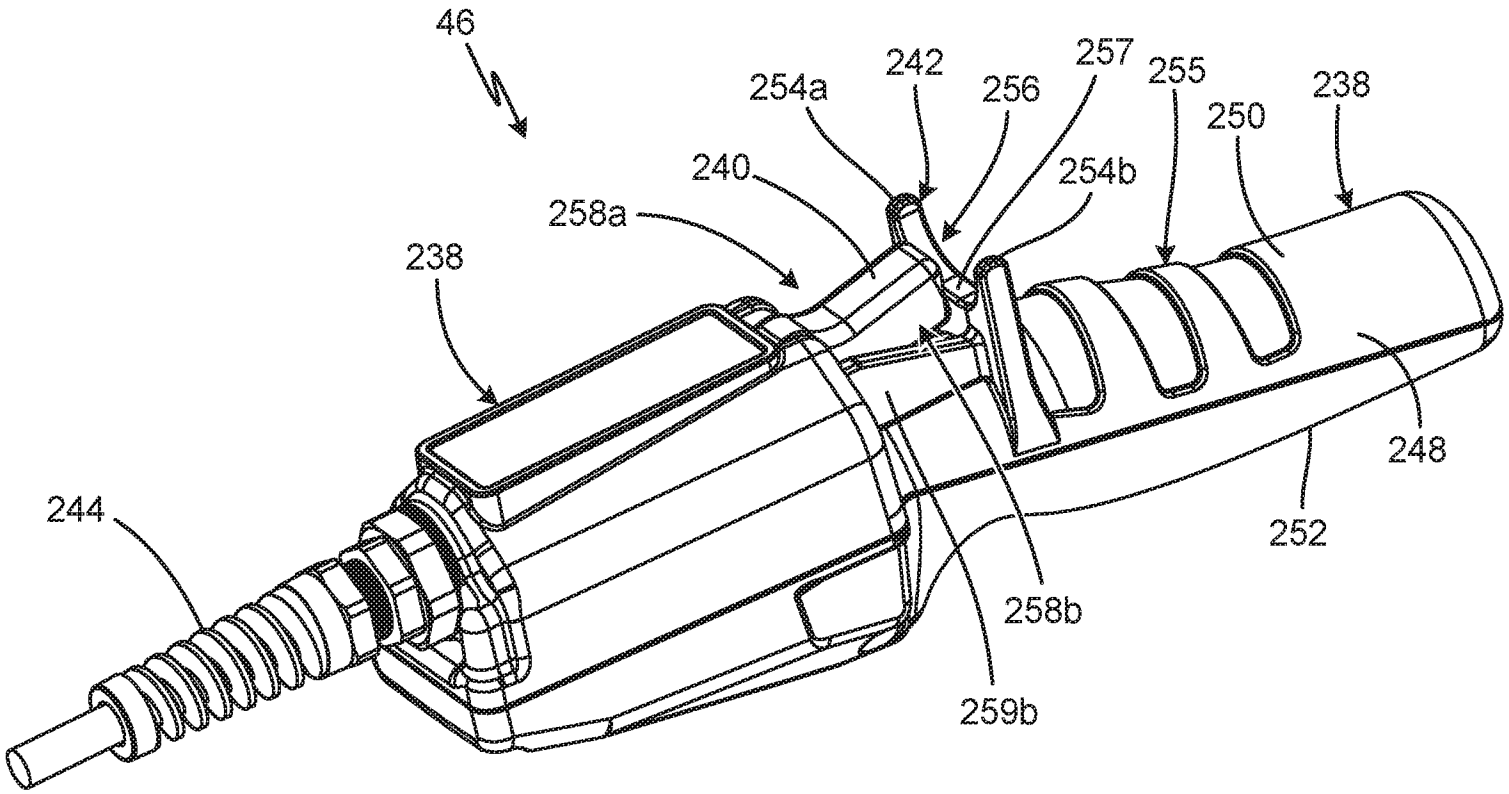
FIG. 8D is a fourth isometric view of the pendant.
Figure 8E:
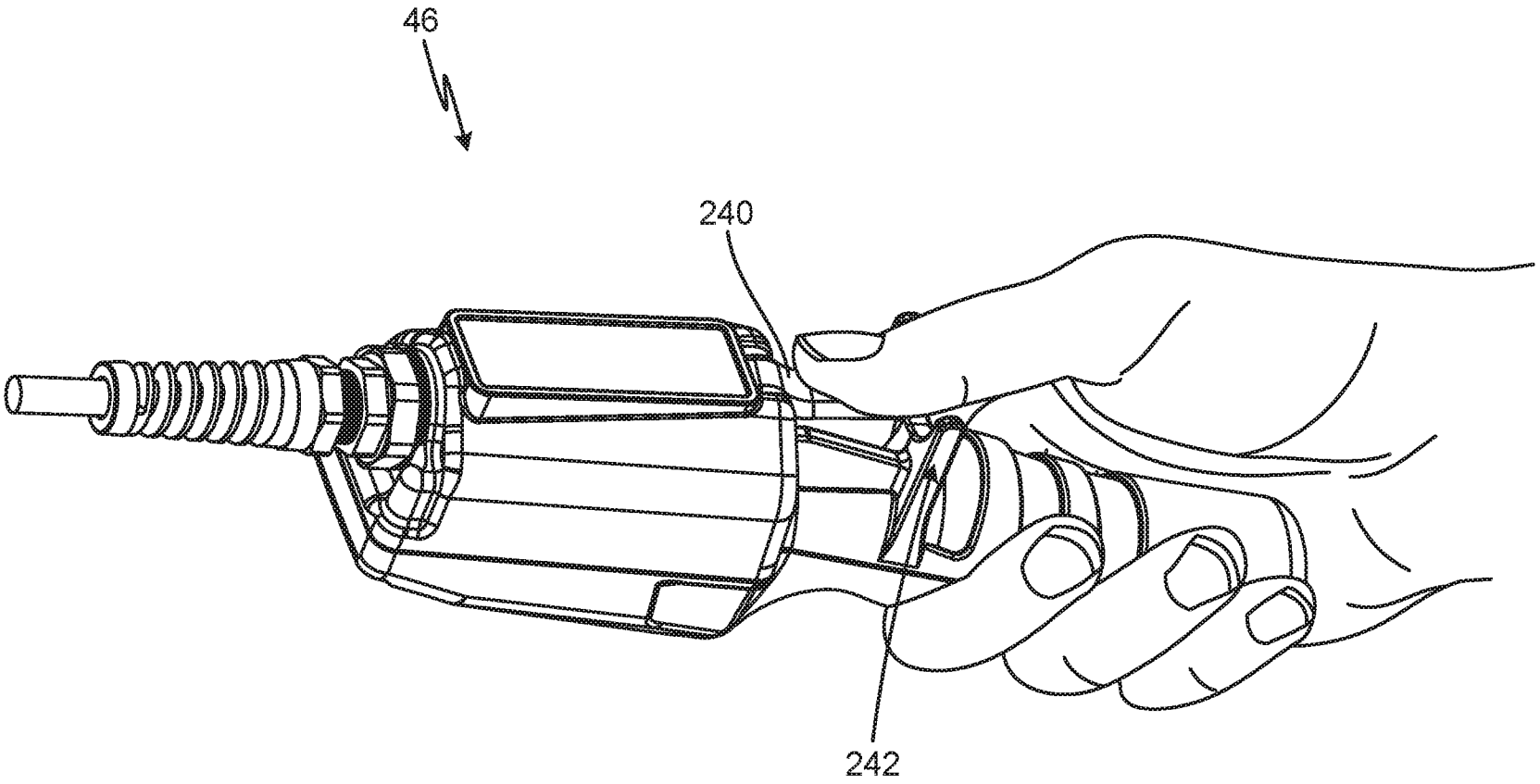
FIG. 8E is an isometric view of the pendant showing trigger actuation by a user's thumb.
Figure 8F:
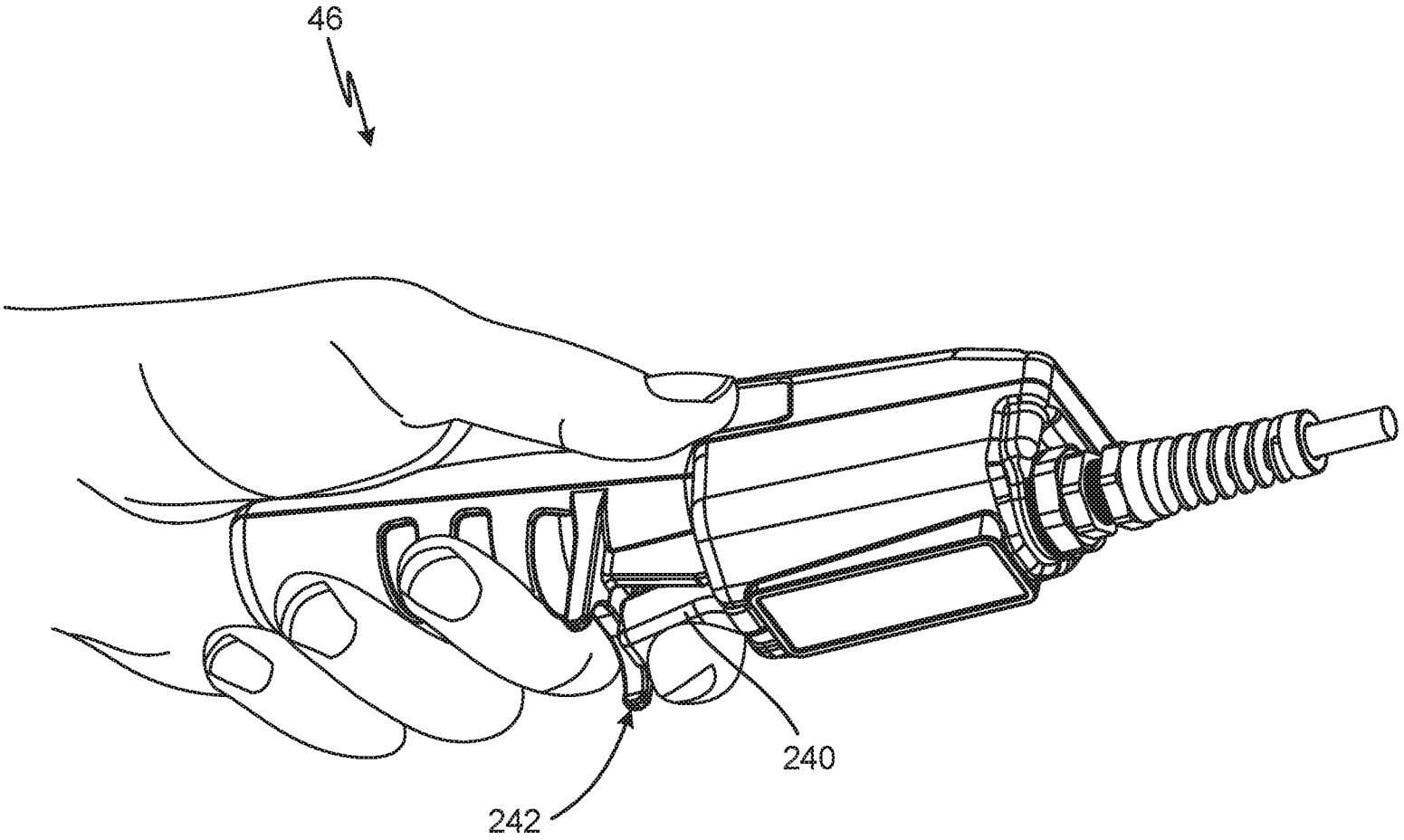
FIG. 8F is an isometric view of the pendant showing trigger actuation by a user's finger.

FIG. 8A is a first isometric view of pendant 46. FIG. 8B is a second isometric view of pendant 46. FIG. 8C is a third isometric view of pendant 46. FIG. 8D is a fourth isometric view of pendant 46. FIG. 8E is an isometric view of pendant 46 showing trigger 240 being actuated by a user's thumb. FIG. 8F is an isometric view of pendant 46 showing trigger 240 being actuated by a user's finger. FIGS. 8A-8F will be discussed together. Pendant 46 includes handle 236, head 238, trigger 240, and trigger guard 242. Head 238 includes antenna 244. Handle 236 includes first lateral side 246 (FIGS. 8A-8C), second lateral side 248 (FIGS. 8A and 8C-8D), front side 250, rear side 252, port 253 (FIGS. 8A and 8C), and grip portion 255. Trigger guard 242 includes prong 254*a*, prong 254*b*, groove 256, cross-piece 257, gap 258*a*, gap 258*b*, first side guard 259*a* (FIGS. 8A and 8B), and second side guard 259*b* (FIGS. 8C and 8D).

Handle 236 extends from head 238, and grip portion 255 is configured to be grasped by a single hand of a user. Trigger 240 extends from front side 250 of handle 236 proximate head 238. Trigger guard 242 surrounds trigger 240 and is configured to prevent undesired actuation or trigger 240. While trigger guard 242 is shown as integrally formed on handle 236 above grip portion 255, it is understood that in some examples trigger guard 242 can be a separate component that is attached to handle 236, such as by one or more threaded fasteners. Prong 254*a* and prong 254*b* are disposed below a bottom edge of trigger 240 above grip portion 255, with trigger 240 positioned between prong 254*a* and 254*b*. Cross-piece 257 extends between prong 254*a* and prong 254*b*. Prong 254*a* extends from first lateral side 246 and front side 250. Prong 254*b* extends from second lateral side 248 and front side 250. Prong 254*a* and prong 254*b* extend further away from front side 250 than trigger 240, thereby preventing trigger 240 from begin inadvertently actuated when pendant 46 is set down. For example, pendant 46 can rest on head 238, prong 254*a*, and prong 254*b* when pendant 46 is set down.

Groove 256 is disposed between prong 254*a* and prong 254*b*, and trigger 240 is accessible through groove 256. Groove 256 is shown as a u-shaped groove open away from cross-piece 257, but it is understood that groove 256 can be any suitable shape for providing user access to trigger 240 by depressing the user's thumb between prong 254*a* and 254*b*. It is understood, that for purposes of actuating trigger 240 a thumb is not considered a finger, and any of the four remaining fingers are not considered the thumb. A width of groove 256 can be greater than a width of trigger 240, to provide user access to trigger 240 through groove 256.

Prong 254*a* is laterally offset towards first lateral side 246 relative to trigger 240 and prong 254*b* is laterally offset towards second lateral side 248 relative to trigger 240, such that trigger 240 is disposed between gap 258*a* and gap 258*b*. First side guard 259*a* extends vertically from the interface of first prong 254*a* and handle 236 to a lower edge of head 238. Second side guard 259*b* similarly extends vertically from the interface of second prong 254*b* and handle 236 to the lower edge of head 238. Trigger 240 is disposed between first side guard 259*a* and second side guard 259*b*.

Gap 258*a* is disposed between prong 254*a* and head 238. Gap 258*a* is a v-shaped opening that is open away from first side guard 259*a*. Gap 258*b* is disposed between prong 254*b* and head 238. Gap 258*b* is a v-shaped opening that is open away from second side guard 259*b*. While gap 258*a* and gap 258*b* are described as v-shaped openings, it is understood that gap 258*a* and gap 258*b* can be of any suitable configuration for providing user access to trigger 240 by depressing one of the user's fingers through gap 258*a*, gap 258*b*, or both. Antenna 244 extends from head 238 and provides wireless communications capabilities to pendant 46. Port 253 extends into handle 236 and is configured to receive a wired communications cable to provide wired communications between pendant 46 and HPU 10 (best seen in FIGS. 1-2D). As such, pendant 46 is configured to communicate through either a wired or wireless connection.

Head 238 houses control circuitry, such as a microcontroller or other logic circuitry, and a communications module for wired and/or wireless communication with control circuitry 48 (FIG. 1) of HPU 10. Trigger 240 is operatively connected to the control circuitry to cause pendant 46 to generate and communicate the extension command and the retraction command to control circuitry 48. For example, the user depressing trigger 240 can generate the extension command to cause control circuitry 48 to cause four-way valve 28 (best seen in FIG. 1) to shift to an extension state, where hydraulic fluid is routed to a hydraulically-driven tool to cause a tool piston, such as tool piston 78 (FIG. 1), to proceed through an extension stroke. The user releasing trigger 240 can generate the retraction command to cause control circuitry 48 to cause four-way valve 28 to shift to a retraction state, where hydraulic fluid is routed to the hydraulically-driven tool to cause the tool piston to proceed through a retraction stroke.

Trigger guard 242 allows the user to access trigger 240 from a multitude of different positions. Trigger guard 242 provides two avenues to access trigger 240 in a right-hand orientation and two avenues to access trigger 240 in a left-hand orientation. As discussed above, prong 254*a* and prong 254*b* extend further from front side 250 than trigger 240, to prevent trigger 240 from being inadvertently actuated. Groove 256 is disposed between prong 254*a* and prong 254*b*. Trigger guard 242 does not include a cover for enclosing trigger 240; instead, prong 254*a* and prong 254*b* provide the only protection to protect trigger 240 from inadvertent actuation. In both the right-hand orientation and the left-hand orientation grip portion 255 is at least partially disposed in the user's palm.

In the right-hand orientation, the user can access trigger 240 with the user's thumb by grasping handle 236 such that first lateral side 246 is disposed in the user's palm, and positioning the user's thumb within groove 256 between prong 254*a* and prong 254*b*. The user's finger can wrap around rear side 252 towards second lateral side 248 of handle 236. The user can then depress trigger 240 with the user's thumb. Alternatively, the user can grasp handle 236 such that second lateral side 248 of handle 236 rests in the user's palm. The user can extend a finger, such as the index finger, through gap 258*b* to access and depress trigger 240.

In the left-hand orientation, the user can access trigger 240 with the user's thumb by grasping handle 236 such that second lateral side 248 is disposed in the user's palm, and positioning the user's thumb within groove 256 between prong 254*a* and prong 254*b*. The user's finger can wrap around rear side 252 towards first lateral side 246 of handle 236. The user can then depress trigger 240 with the user's thumb. Alternatively, the user can grasp handle 236 such that first lateral side 246 of handle 236 rests in the user's palm. The user can extend a finger, such as the index finger, through gap 258*a* to access and depress trigger 240.

Pendant 46 provides significant advantages. Trigger guard 242 enables the user to depress trigger 240 with either the user's left hand or the user's right hand. The user can access trigger 240 with a finger through either gap 258*a* or gap 258*b*, and the user can access trigger 240 with a thumb through groove 256. Trigger guard 242 provides ergonomic control of pendant 46 and provides user flexibility in control of pendant 46, thereby reducing user fatigue.

Figure 9B:
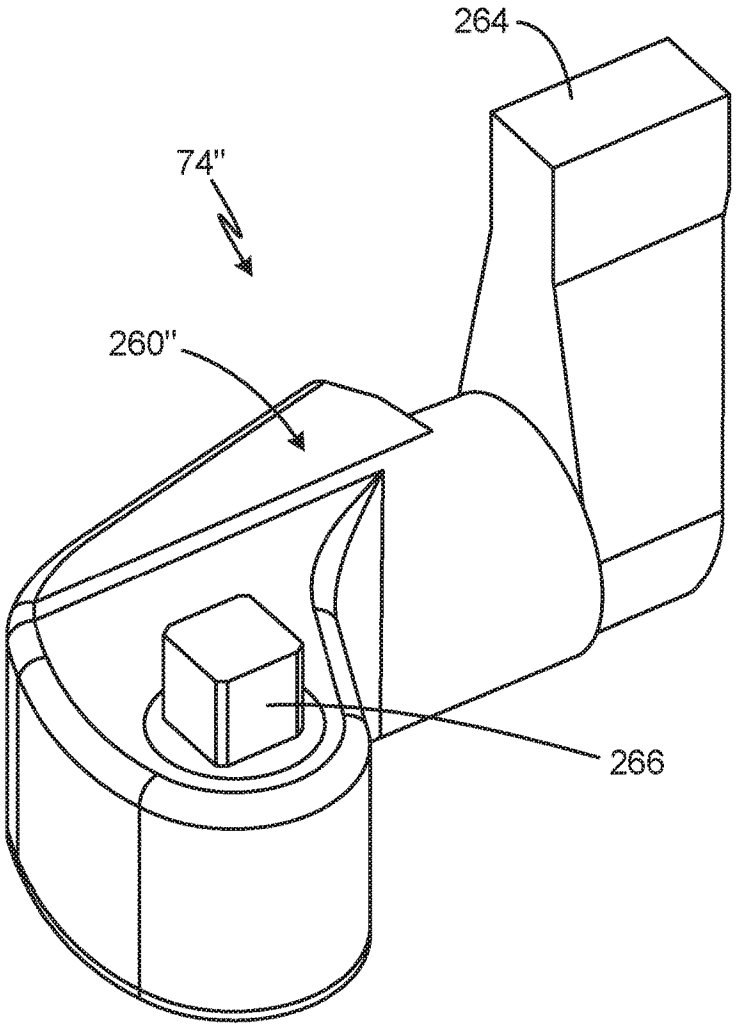
FIG. 9B is an isometric view of a second hydraulically driven tool.
Figure 9A:
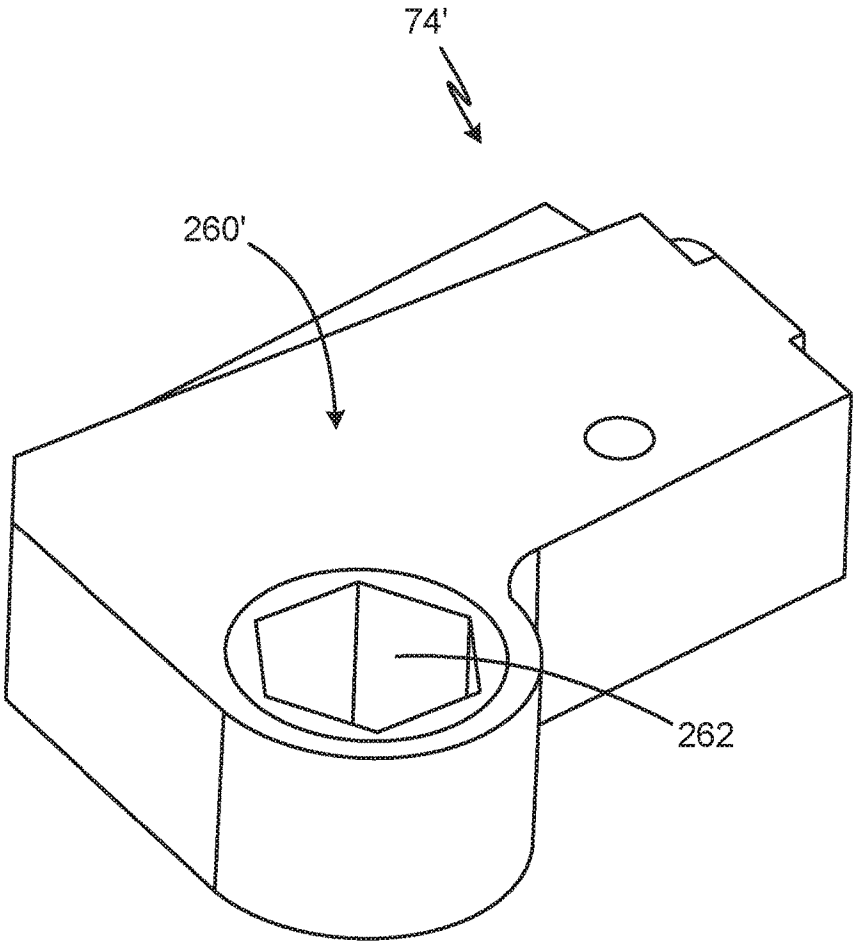
FIG. 9A is an isometric view of a first hydraulically driven tool.

FIG. 9A is an isometric view of tool 74'. FIG. 9B is an isometric view of tool 74". FIGS. 9A and 9B will be discussed together. Tool 74' includes tool body 260' and socket 262. Tool 74" includes tool body 260", brace 264, and driving head 266.

Tool 74' includes an internal tool piston, such as tool piston 78 (FIG. 1), that drives rotation of socket 262 via a ratchet mechanism. Hydraulic fluid is provided to tool body 260' by hydraulic hoses, such as external hydraulic hose 76*a* (FIG. 1) and external hydraulic hose 76*b* (FIG. 1), connected to fluid ports 30 (best seen in FIG. 2A). The hydraulic fluid acts on the tool piston to drive rotation of socket 262. Socket 262 is configured to receive a head of a fastener to either tighten or loosen the fastener in high-torque applications, amongst other uses.

Similarly, tool 74" includes an internal tool piston, such as tool piston 78 (FIG. 1), that drives rotation of driving head 266 via a ratchet mechanism. Brace 264 is configured to brace against an anchor point during operation and prevent rotation of tool 74". Hydraulic fluid is provided to tool body 260" by hydraulic hoses, such as external hydraulic hose 76*a* (FIG. 1) and external hydraulic hose 76*b* (FIG. 1), connected to fluid ports 30 (best seen in FIG. 2A). The hydraulic fluid acts on the tool piston to drive rotation of driving head 266. Driving head 266 is configured to extend into a socket of a fastener to either tighten or loosen the fastener in high-torque applications, amongst other uses.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A trigger guard for a control pendant, the trigger guard comprising:

a first prong extending from a first end of a cross-piece;

a second prong extending from a second end of the cross-piece;

a groove disposed between the first prong and the second prong, the groove defined by the first prong, the second prong, and the cross-piece;

a first side guard extending vertically from the cross-piece and the first prong;

a second side guard extending vertically from the cross-piece and the second prong;

a first gap disposed between the first prong and the first side guard; and a second gap disposed between the second prong and the second side guard;

wherein the first side guard and the second side guard are spaced to receive a trigger configured to be actuated by depressing and releasing the trigger, the trigger extending from between the first side guard and the second side guard such that the trigger is accessible to be depressed and released through each of the groove, the first gap, and the second gap.

2. The trigger guard of claim 1, wherein the first prong extends further from the first side guard than the trigger, and the second prong extends further from the second side guard than the trigger.

3. The trigger guard of claim 1, wherein the first gap is a v-shaped gap open towards a distal end of the first prong.

4. The trigger guard of claim 1, wherein the second gap is a v-shaped gap open towards a distal end of the second prong.

5. The trigger guard of claim 1, wherein the groove is a u-shaped groove open between a distal end of the first prong and a distal end of the second prong.

6. The trigger guard of claim 1, wherein the first prong is disposed below a bottom edge of the trigger, and the second prong is disposed below a bottom edge of the trigger.

7. The trigger guard of claim 1, wherein the first prong is offset laterally from the first side guard in a first direction, and the second prong is offset laterally from the second side guard in a second direction opposite the first direction.

8. The trigger guard of claim 7, wherein the first prong is offset laterally from the trigger in the first direction and the second prong is offset laterally from the trigger in the second direction, such a width of the groove is larger than a width of the trigger.

9. The trigger guard of claim 1, wherein the first prong and the second prong are freestanding such that a guard does not extend between and connect a first prong distal end and a second prong distal end.

10. A control pendant comprising:

a head configured to house electronic components of the pendant;

a handle extending from the head, the handle including a first lateral side, a second lateral side, a rear side, and a front side; and the trigger guard of claim 1 projecting from the front side of the handle proximate the head;

wherein the trigger guard is configured to provide user access to the trigger in a plurality of hand orientations, and the trigger guard is configured to provide user access to the trigger in a plurality of positions for each one of the plurality of hand orientations.

11. The trigger guard of claim 1, wherein the control pendant is configured to control a hydraulic power unit.

12. A method of controlling with a control pendant, the control pendant having a head, a handle extending from the head, and a trigger extending from a front side of the handle proximate the head and disposed within a trigger guard extending from the front side, the trigger guard having a first prong, a second prong spaced laterally from the first prong, a groove disposed between the first prong and the second prong, a first gap disposed between the first prong and the head, and a second gap disposed between the second prong and the head, with the trigger accessible via each of the first gap, the second gap, and the groove, the method comprising:

grasping the handle of the pendant in one of a left-hand orientation and a right-hand orientation; and accessing the trigger by one of:

shifting a thumb into the groove and towards the handle to depress the trigger and shifting the thumb away from the handle within the groove to release the trigger; and shifting a finger into one of the first gap and the second gap and towards the handle to depress the trigger and shifting the finger away from the handle within the one of the first gap and the second gap to release the trigger.

13. The method of claim 12, wherein grasping the handle of the pendant in the right-hand orientation comprises:

positioning the first lateral side in a right palm of a user such that at least one finger wraps around the front side of the handle; and accessing the trigger with a right hand finger of the user through the first gap.

14. The method of claim 12, wherein grasping the handle of the pendant in the right-hand orientation comprises:

positioning the second lateral side in a right palm of the user such that at least one right hand finger wraps around the back side of the handle; and accessing the trigger with a right thumb of the user through the groove by lowering the right thumb between a first prong distal end and a second prong distal end and into the groove.

15. The method of claim 12, wherein grasping the handle of the pendant in the left-hand orientation comprises:

positioning the second lateral side in a left palm of a user such that at least one finger wraps around the front side of the handle; and accessing the trigger with a left hand finger of the user through the second gap.

16. The method of claim 12, wherein grasping the handle of the pendant in the left-hand orientation comprises:

positioning the first lateral side in a left palm of the user such that at least one left hand finger wraps around the back side of the handle; and accessing the trigger with a left thumb of the user through the groove by lowering the left thumb between a first prong distal end and a second prong distal end and into the groove.

17. The method of claim 12, further comprising:

generating and communicating, by the pendant, an extension command to the hydraulic power unit based on the trigger being depressed.

18. The method of claim 12, further comprising:

controlling operation of a hydraulic power unit by depressing and releasing the trigger.

19. A control pendant having a trigger, the trigger actuatable by either a finger or a thumb of a user's hand gripping the pendant, the pendant comprising:

a body having a first side and a second side opposite the first side, the body comprising:

a grip configured to be held by a user's hand, the grip extending between the first side and the second side of the body;

a pair of prongs located on the first side of the body; and a groove located on the first side of the body and defined by and between the pair of prongs, each of the prongs having a free end that is not bridged to the free end of the other prong such that the groove is open; and a trigger located on the first side of the body, the trigger aligned with the groove, the pair of prongs located between the trigger and the grip along the body;

wherein the body is configured to be held in first and second orientations;

wherein in the first orientation the user's hand grips the grip and the user's thumb moves in the groove between the pair of prongs to depress and release the trigger; and wherein in the second orientation the user's hand grips the grip and the user's finger depresses and releases the trigger without moving within the groove between the pair of prongs.

20. The pendant of claim 19, wherein in the first orientation the first side of the body faces the user while in the second orientation the second side faces the user.

21. The pendant of claim 19, wherein each of the pair of prongs extends further away from the body than the trigger to shield the trigger from inadvertent actuation.

22. A method of actuating a control pendant having a trigger, the control pendant comprising the trigger and a body having a first side and a second side opposite the first side, the body comprising a grip extending between the first side and the second side of the body, a pair of prongs located on the first side of the body, and a groove located on the first side of the body and defined by and between the pair of prongs, each of the prongs having a free end that is not bridged to the free end of the other prong such that the groove is open, the trigger located on the first side of the body and aligned with the groove, the pair of prongs located between the trigger and the grip along the body, the method comprising:

depressing and releasing the trigger in a first orientation in which the user's hand grips the grip while the user's thumb of the hand moves in the groove between the pair of prongs to access the trigger; and depressing and releasing the trigger in a second orientation in which the user's hand grips the grip while the user's finger of the hand accesses the trigger without moving between the pair of prongs.

23. A trigger guard for a control pendant, the trigger guard comprising:

a first prong extending from a first end of a cross-piece;

a second prong extending from a second end of the cross-piece;

a groove disposed between the first prong and the second prong, the groove defined by the first prong, the second prong, and the cross-piece;

a first side guard extending vertically from the cross-piece and the first prong;

a second side guard extending vertically from the cross-piece and the second prong;

a first gap disposed between the first prong and the first side guard; and a second gap disposed between the second prong and the second side guard;

wherein the first side guard and the second side guard are spaced to receive a trigger, the trigger extending from between the first side guard and the second side guard such that the trigger is accessible through the groove, the first gap, and the second gap; and wherein the first prong is disposed below a bottom edge of the trigger, and the second prong is disposed below a bottom edge of the trigger.

* * * * *